US008182973B2

(12) United States Patent
Matsumura et al.

(10) Patent No.: US 8,182,973 B2
(45) Date of Patent: May 22, 2012

(54) ELECTROSTATIC-IMAGE-DEVELOPING TONER, PROCESS FOR PRODUCING ELECTROSTATIC-IMAGE-DEVELOPING TONER, ELECTROSTATIC IMAGE DEVELOPER, IMAGE-FORMING METHOD, AND IMAGE-FORMING APPARATUS

(75) Inventors: Yasuo Matsumura, Kanagawa (JP); Hirotaka Matsuoka, Kanagawa (JP); Hideo Maehata, Kanagawa (JP); Takashi Imai, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 532 days.

(21) Appl. No.: 12/404,025

(22) Filed: Mar. 13, 2009

(65) Prior Publication Data

US 2010/0047706 A1 Feb. 25, 2010

(30) Foreign Application Priority Data

Aug. 22, 2008 (JP) ..... 2008-213836

(51) Int. Cl.
*G03G 9/00* (2006.01)

(52) U.S. Cl. ..... 430/110.2; 430/108.1; 430/108.4; 430/109.4

(58) Field of Classification Search ..... 430/108.1, 430/108.4, 109.4, 110.2
See application file for complete search history.

(56) References Cited

U.S. PATENT DOCUMENTS

| | | | | |
|---|---|---|---|---|
| 4,543,311 | A * | 9/1985 | Takagiwa et al. | 430/123.55 |
| 2006/0194135 | A1* | 8/2006 | Hayashi et al. | 430/108.4 |
| 2007/0048647 | A1* | 3/2007 | Daimon et al. | 430/110.2 |
| 2007/0092821 | A1* | 4/2007 | Sato et al. | 430/108.4 |
| 2007/0092823 | A1 | 4/2007 | Matsumura et al. | |
| 2007/0093598 | A1* | 4/2007 | Heinrichs | 524/800 |
| 2007/0254229 | A1* | 11/2007 | Patel et al. | 430/108.4 |

FOREIGN PATENT DOCUMENTS

| | | |
|---|---|---|
| AU | 2006235981 A1 | 12/2007 |
| GB | 1 431 699 | 4/1976 |
| JP | A-49-17739 | 2/1974 |
| JP | A-57-201246 | 12/1982 |
| JP | A-58-86557 | 5/1983 |
| JP | A-61-56355 | 3/1986 |
| JP | A-08-050368 | 2/1996 |
| JP | A-2004-252226 | 9/2004 |
| JP | A-2004-354811 | 12/2004 |
| JP | A-2007-114635 | 5/2007 |
| JP | A-2007-310064 | 11/2007 |
| JP | A-2007-322953 | 12/2007 |

OTHER PUBLICATIONS

Japanese Office Action issued in Japanese Patent Application No. 2008-213836 on May 19, 2010 (with translation).

* cited by examiner

*Primary Examiner* — Mark F Huff
*Assistant Examiner* — Stewart Fraser
(74) *Attorney, Agent, or Firm* — Oliff & Berridge, PLC

(57) ABSTRACT

An electrostatic-image-developing toner is obtained by aggregating: resin particles, each of which has a core-shell structure, in which a difference in glass transition temperature between a resin constituting the core and a resin constituting the shell is about 20° C. or more; and releasing agent particles, each of which includes a polyester block copolymer having a weight-average molecular weight of about 3,000 or less and containing a non-crystalline polyester block containing a cyclic structure in the main chain and a crystalline polyester block containing no cyclic structure in the main chain.

15 Claims, No Drawings

ELECTROSTATIC-IMAGE-DEVELOPING TONER, PROCESS FOR PRODUCING ELECTROSTATIC-IMAGE-DEVELOPING TONER, ELECTROSTATIC IMAGE DEVELOPER, IMAGE-FORMING METHOD, AND IMAGE-FORMING APPARATUS

CROSS-REFERENCE TO RELATED APPLICATIONS

This application is based on and claims priority under 35 USC 119 from Japanese Patent Application No. 2008-213836 filed on Aug. 22, 2008.

BACKGROUND

1. Technical Field

The present invention relates to an electrostatic-image-developing toner, a process for producing an electrostatic-image-developing toner, an electrostatic image developer, an image-forming method, and an image-forming apparatus.

2. Related Art

With electrostatic-image-developing toners using addition polymerization type resins or polycondensation type resins comprising a random monomer chain, fixing of a toner image has been predominantly accelerated by heating rather than pressure.

SUMMARY

According to an aspect of the invention, there is provided an electrostatic-image-developing toner obtained by aggregating: resin particles, each of which has a core-shell structure, in which a difference in glass transition temperature between a resin constituting the core and a resin constituting the shell is about 20° C. or more; and releasing agent particles, each of which includes a polyester block copolymer having a weight-average molecular weight of about 3,000 or less and containing a non-crystalline polyester block containing a cyclic structure in the main chain and a crystalline polyester block containing no cyclic structure in the main chain.

DETAILED DESCRIPTION

In the case where the toners described in JP-A-49-17739, JP-A-58-86557, JP-A-57-201246 and JP-A-61-56355 are used in electrophotographic process according to the common pressure fixing, there has not been obtained sufficient fixing performance. Also, in an environment of high humidity, recording materials such as transfer paper suffer reduction in stiffness and strength and suffer increase in adhesion to a fixing member (fixing unit), thus sufficient releasing properties upon fixing not being obtained. In particular, under continuous running, there have occurred problems relating to reliability, such as paper jam, paper wrinkling, and creasing, due to adhesion of the recording material to the fixing unit.

In addition, fluidity of the toner under pressure is insufficient, which requires application of higher pressure. Thus, stress to the recording material such as transfer paper is increased and, at the same time, adhesion properties between the recording material and the fixing unit are more enhanced, resulting in occurrence of the problem of reduction in paper passing reliability.

According to the present invention, fixing can be conducted by heat-pressing, preferably only pressing, and paper can be stably passed even in an environment of high humidity, by using an electrostatic-image-developing toner using a specific resin as a binder resin and containing a specific releasing agent of 3,000 or less in molecular weight.

The electrostatic-image-developing toner to be used in the invention will be described below, followed by description on the image-forming method of the invention.

I. Electrostatic-Image-Developing Toner

The electrostatic-image-developing toner (hereinafter also referred to merely as "toner") is characterized by being obtained by aggregating resin particles having a core-shell structure wherein the difference in glass transition temperature (hereinafter also referred to as "Tg") between the resin constituting the core and the resin constituting the shell is about 20° C. or more and releasing agent particles of a polyester block copolymer having a weight-average molecular weight of about 3,000 or less and containing a non-crystalline polyester block containing a cyclic structure in the main chain and a crystalline polyester block containing no cyclic structure in the main chain.

In the case where a high-Tg resin (resin having a high glass transition temperature) and a low-Tg resin (resin having a low glass transition temperature) form a microscopic phase separation state, the resin shows a plastic behavior for pressure and, under a pressure of, or more than, a certain level, it shows a fluidity even in an ordinary temperature range. Such resin is in some cases referred to as baroplastic. In the case where the ambient temperature is at a high level, such plastic behavior and fluidity are promoted and, even under a lower pressure, there can be obtained a resin fluidity necessary for fixing.

The electrostatic-image-developing toner of the invention utilizes the baroplastic as a binder resin and a releasing agent.

In the case where a pressure of, or more than, a certain level is applied to the toner, fluidity is imparted to the toner and, under a lower pressure, the toner acts as an extreme solid, which ensures high reliability in other steps than the heat-and-pressure fixing step in the electrophotographic process, such as a developing step, a transfer step, and a cleaning step.

Such high reliability imparted to the toner permits use of a toner having a particle size as small as, or smaller than, 5 μm, which has been difficult to practice. This permits reduction of toner consumption and formation of a highly fine image, thus high image quality, reliability, and economic advantage owing to reduction of toner consumption being attained at the same time.

Further, the electrostatic-image-developing toner of the invention contains therein a releasing agent composed of a polyester block copolymer having a weight-average molecular weight of about 3,000 or less and containing a non-crystalline polyester block containing a cyclic structure in the main chain and a crystalline polyester block containing no cyclic structure in the main chain. Such releasing agent having a comparatively low molecular weight becomes fluid with a low viscosity under pressure, whereby releasing properties between a toner image and a pressure-fixing unit upon fixing can be enhanced, with the pressure necessary for fixing being decreased.

In the invention, the fundamental advantage is that both fixing properties at an ordinary temperature and reliability relating to passing of paper can be obtained by positively using the effect of a microscopic phase separation-causing resin to become plastic under pressure upon fixing, said resin including domains different from each other in Tg, and by incorporating a similar pressure fluidizable compound.

Binder Resin

Resin Particles Having a Core-Shell Structure

The electrostatic-image-developing toner to be used in the invention is an electrostatic-image-developing toner obtained by aggregating resin particles having a core-shell structure (hereinafter also merely referred to as "core-shell particles") wherein the difference in glass transition temperature between the resin constituting the core and the resin constituting the shell is about 20° C. or more. The resin constituting the core or the resin constituting the shell preferably contains a non-crystalline addition polymerization type resin, with both the resin constituting the core and the resin constituting the shell being preferably non-crystalline addition polymerization type resins.

In the invention, with respect to the resin constituting the core and the resin constituting the shell, core or shell having a higher Tg is also referred to as a high-Tg phase, and core or shell having a lower Tg is also referred to as a low-Tg phase. Tg of the high-Tg phase is preferably equal to or higher than 40° C. and equal to or lower than 80° C. (in the invention, "equal to or higher than 40° C. and equal to or lower than 80° C." or the like is also described as "from 40 to 80° C." or the like, or "from 40° C. to 80° C." or the like; hereinafter the same applies to description of other numerical ranges), more preferably in the range of from 45 to 70° C.

When Tg of the high-Tg phase is 40° C. or higher, the resulting toner has excellent storage properties, suffers less occurrence of caking during transportation or within a machine such as a printer, less causes filming on a photoreceptor during continuous printing, and less causes image defects, thus such range of Tg of the high-Tg phase being preferred.

Also, when Tg of the high-Tg phase is 80° C. or lower, the fixing temperature upon fixing can be at an appropriate level, and the fixing pressure can be adjusted to an appropriate range, which serves to cause less damage to a recording material such as curling. In addition, fixing can be conducted only by applying pressure without heating in a using environment of room temperature (25° C.). Thus, such range of Tg of the high-Tg phase is preferred.

Also, Tg of the low-Tg phase is lower than Tg of the high-Tg phase by about 20° C., preferably by about 30° C. In case when the difference in Tg between the high-Tg phase and the low-Tg phase becomes less than 20° C., sufficient plasticity-acquiring behavior under pressure is scarcely observed, and the fixing temperature required upon fixing becomes so high that fixing without heating becomes difficult.

The glass transition temperature of a resin can be measured according to a known method. For example, it can be measured according to the method provided in ASTM D3418-82 (DSC method). "Crystallinity" shown with the above "crystalline resins" means to have a definite endothermic peak, not stepwise endothermic variation, in differential scanning calorimetry (DSC), and specifically means that the half value width of the endothermic peak measured at a temperature increasing rate of 10° C./min is not more than 15° C.

On the other hand, resins having the half value width of endothermic peak exceeding 15° C. and resins not having a definite endothermic peak mean to be non-crystalline (amorphous). The glass transition temperature of the non-crystalline resin according to DSC is measured in accordance with ASTM D3418 by means of a differential scanning calorimeter (DSC-50) equipped with an automatic tangent processing system (manufactured by Shimadzu Seisakusho Co., Ltd.) One example of measuring conditions is shown below.

Sample: 3 to 15 mg, preferably 5 to 10 mg

Measuring method: The sample is placed in an aluminum pan, with a blank aluminum pan for reference.

Temperature curve: Temperature-increasing condition I (from 20° C. to 180° C.; temperature-increasing rate: 10° C./min)

In the above temperature curve, the glass transition temperature is measured based on the endothermic curve measured during temperature-increasing period. The glass transition temperature is a temperature at which the differentiated value of the endothermic curve becomes maximum.

In the invention, resins which can be used for the resin particles having a core-shell structure are not particularly limited so long as the difference in Tg between the resin to be used as a core and the resin to be used as a shell is 20° C. or more. However, the resin constituting the core and/or the resin constituting the shell is preferably a non-crystalline resin, more preferably a non-crystalline addition polymerization type resin, still more preferably a non-crystalline homopolymer or copolymer of an ethylenically unsaturated monomer.

As monomers for constituting the homopolymers or copolymers, there can preferably be illustrated, for example, styrenes, (meth)acrylic acid esters ("(meth)acrylic acid" means "acrylic acid and/or methacrylic acid; hereinafter the same), ethylenically unsaturated nitriles, ethylenically unsaturated carboxylic acids, vinyl ethers, vinyl ketones, and olefins.

More specifically, there can preferably be illustrated styrene; vinylnaphthalene; alkyl-substituted stylenes having an alkyl chain, such as 2-methylstyrene, 3-methylstyrene, 4-methylstyrene, 2-ethylstyrene, 3-ethylstyrene, and 4-ethylstyrene; halogen-substituted styrenes such as 2-chlorostyrene, 3-chlorostyrene, and 4-chlorstyrene; fluorine-substituted styrenes such as 4-fluorostyrene and 2,5-difluorostyrene; a (meth)acrylate monomer such as methyl acrylate, ethyl acrylate, propyl acrylate, butyl acrylate, lauryl acrylate, 2-ethylhexyl acrylate, methyl methacrylate, ethyl methacrylate, propyl methacrylate, butyl methacrylate, hexyl methacrylate, lauryl methacrylate, 2-ethylhexyl methacrylate, and β-carboxyethyl acrylate; ethylenically unsaturated nitriles such as acrylonitrile and methacrylonitrile; ethylenically unsaturated carboxylic acids such as acrylic acid, methacrylic acid, and crotonic acid; vinyl ethers such as vinyl methyl ether and vinyl isobutyl ether; vinyl ketones such as vinyl methyl ketone, vinyl ethyl ketone, and vinyl isopropenyl ketone; and olefins such as isoprene, butene, and butadiene. Homopolymers composed of these monomers, copolymers obtained by copolymerizing two or more of these monomers and, further, mixtures thereof may be used.

As the specific combination of the resins different from each other in Tg by 20° C. or more and capable of forming the microscopic phase separation structure, there can preferably be illustrated, for example, a combination of polystyrene and polybutyl acrylate, a combination of polystyrene and polybutyl methacrylate, a combination of polystyrene and poly(2-ethylhexyl acrylate), a combination of polymethyl methacrylate and polybutyl methacrylate, a combination of polystyrene and polyhexyl methacrylate, a combination of polyethyl methacrylate and polyethyl acrylate, and a combination of polyisoprene and polybutylene.

The term "a combination of polystyrene and polybutyl acrylate" and the like as used herein means a combination of a homopolymer or copolymer containing styrene as a monomer unit in a content of 50% by weight or more and a homopolymer or copolymer containing butyl acrylate as a monomer unit in a content of 50% by weight or more, with the same applying to other combinations.

With resin particles having a core-shell structure based on such combination, plasticity-acquiring behavior under pressure can be observed whichever resin constitutes the shell or the core. In order to obtain both toner properties and durability during transportation or storage, the shell is preferably constituted by the high-Tg phase.

In the case where the core is constituted by the low-Tg phase, about 80% by weight or more of the monomer units constituting the resin constituting the core is preferably constituted by a (meth)acrylic acid ester, and about 80% by weight or more of the monomer units constituting the resin constituting the core is more preferably constituted by an acrylic acid ester.

In the case where the shell is constituted by the high-Tg phase, 60% by weight or more of the monomer units constituting the resin constituting the shell is preferably constituted by a styrene.

Also, the resin constituting the shell preferably contains a (meth)acrylic acid ester as a monomer unit in addition to the styrene.

For example, a copolymer obtained by polymerizing a monomer mixture containing 60% by weight of a styrenic monomer and 10 to 40% by weight of a (meth)acrylic acid ester can preferably be used. The (meth)acrylic acid ester is preferably the same as the (meth)acrylic acid ester used as a major component (50% by weight or more) of the core. Incorporation of a monomer unit in the resin constituting the shell which monomer is the same as is incorporated in the core provides easy miscibility of the high-Tg phase and the low-Tg phase upon application of pressure, thus being preferred.

In the invention, the resin constituting the shell preferably has an acidic or basic polar group or an alcoholic hydroxyl group.

In order to use the resin particles having the core-shell structure in a toner in a content of 20% by weight or more, more preferably 50% by weight or more, it is preferred to impart to the particles controllable properties to form a toner in an aqueous medium, i.e., properties of permitting control of particle diameter and particle diameter distribution. In order to facilitate such control by addition of an aggregating agent, it is effective to incorporate in the particle resin an acidic or basic polar group or an alcoholic hydroxyl group. Introduction of such groups can be achieved by using, as the shell component, a resin obtained by copolymerizing a monomer having such polar group.

Preferred examples of the acidic polar group include a carboxyl group, a sulfonic acid group, and an acid anhydride.

As the monomer for forming an acidic polar group in the resin, there are illustrated α,β-ethylenically unsaturated compounds having a carboxyl group or a sulfonic acid group, and preferred specific examples thereof include acrylic acid, methacrylic acid, fumaric acid, maleic acid, itaconic acid, cinnamic acid, sulfonated styrene, and allylsulfosuccinic acid.

Of these, monomers having a carboxylic acid are preferred, with acrylic acid being more preferred.

Preferred examples of the basic polar group include an amino group, an amido group, and a hydrazide group.

As the monomer for forming a basic polar group in the resin, there are illustrated nitrogen atom-containing monomers (hereinafter also referred to as "nitrogen-containing monomers"). Preferred compounds to be used as the nitrogen-containing compounds include (meth)acrylic acid amide compounds, (meth)acrylic acid hydrazide compounds, and aminoalkyl(meth)acrylate compounds.

Illustrative examples of the nitrogen-containing monomers include acrylic acid amide, methacrylic acid amide, acrylic acid methylamide, methacrylic acid methylamide, acrylic acid dimethylamide, acrylic acid diethylamide, acrylic acid phenylamide, and acrylic acid benzylamide as the (meth) acrylic acid amide compounds; acrylic acid hydrazide, methacrylic acid hydrazide, acrylic acid methylhydrazide, methacrylic acid methylhydrazide, acrylic acid dimethylhydrazide, and acrylic acid phenylhydrazide; and 2-aminoethyl acrylate and 2-aminoethyl methacrylate as the aminoalkyl(meth)acrylates. Additionally, the aminoalkyl (meth)acrylate compounds may be monoalkylamino(meth) acrylate compounds or dialkylamino(meth)acrylate compounds and, as an example thereof, there is illustrated 2-diethylaminoethyl(meth)acrylate.

Of these, aminoalkyl(meth)acrylate compounds are preferred, with 2-diethylaminoethyl(meth)acrylate being more preferred.

As the monomer for forming an alcoholic hydroxyl group, hydroxy acrylates are preferred. Specific examples thereof include 2-hydroxyethyl(meth)acrylate, hydroxypropyl (meth)acrylate, and hydroxybutyl(meth)acrylate. Of these, 2-hydroxyethyl(meth)acrylate is preferred.

The monomers having a polar group or an alcoholic hydroxyl group may be used independently or in combination of plural members thereof.

The content of the monomer having the polar group is in the range of preferably from 0.01 to 20% by weight, more preferably from 0.1 to 10% by weight, of the total weight of monomers used for the shell layer. When the content is within the above-mentioned range, controllability upon formation of a toner in an aqueous medium can be imparted, thus such content being preferred.

In the invention, polymerization reaction between the monomer and a previously prepared prepolymer of a monomer can be included. The prepolymer is not particularly limited so long as it can be molten into, or uniformly mixed with, the monomer.

Further, the binder resin which can be used in the invention may contain a homopolymer of the monomer described above, a copolymer composed of a combination of two or more monomers including the above-described monomers, a mixture thereof, a graft polymer, or a partially branched or crosslinked structure.

To the binder resin which can be used in the invention may be added, as needed, a crosslinking agent to prepare a crosslinked resin. Typical crosslinking agents are multi-functional monomers having two or more ethylenically unsaturated groups within the molecule.

Specific examples of the crosslinking agent include aromatic polyvinyl compounds such as divinylbenzene and divinylnaphthalene; polyvinyl esters of an aromatic polyvalent carboxylic acid, such as divinyl phthalate, divinyl isophthalate, divinyl terephthalate, divinyl homophthalate, divinyl/trivinyl trimesate, divinyl naphthalenedicarboxylate, and divinyl biphenylcarboxylate; divinyl esters of a nitrogen-containing aromatic compound, such as divinyl pyridinedicarboxylate; vinyl esters of an unsaturated heterocyclic compound, such as vinyl pyrromucinate, vinyl furancarboxylate, vinyl pyrrol-2-carboxylate, and vinyl thiophenecarboxylate; multi-functional (meth)acrylic acid esters of a linear polyhydric alcohol, such as butanediol dimethacrylate, hexanediol diacrylate, octanediol dimethacrylate, decanediol diacrylate, and dodecanediol dimethacrylate; (meth)acrylic acid esters of a branched or substituted polyhydric alcohol, such as neopentylglycol dimethacrylate and 2-hydroxy-1,3-diacryloxypropane; polyethylene glycol di(meth)acrylate and polypropylene polyethylene glycol di(meth)acrylate; and multifunctional vinyl esters of a polyvalent carboxylic acid, such as divinyl succinate, divinyl fumarate, vinyl/divinyl maleate, divinyl diglycolate, vinyl/divinyl itaconate, divinyl acetonedicarboxylate, divinyl glutarate, divinyl 3,3'-thiodipropionate, divinyl/trivinyl trans-aconitate, divinyl adipate, divinyl pimelate, divinyl suberate, divinyl azelate, divinyl sebacate, divinyl dodecanedicarboxylate, and divinyl brassylate.

In the invention, these crosslinking agents may be used independently or in combination of two or more kinds thereof. Of the above-described crosslinking agents, (meth) acrylic acid esters of a linear polyhydric alcohol, such as butanediol dimethacrylate, hexanediol diacrylate, octanediol dimethacrylate, decanediol diacrylate, and dodecanediol dimethacrylate; (meth)acrylic acid esters of a branched or substituted polyhydric alcohol, such as neopentylglycol dimethacrylate and 2-hydroxy-1,3-diacryloxypropane; and polyalkylene glycol di(meth)acrylate and polypropylene polyethylene glycol di(meth)acrylate are preferred to use.

The content of the crosslinking agent is preferably from 0.05to 5% by weight, more preferably from 0.1 to 1.0% by weight, based on the total amount of the polymerizable monomers.

The weight-average molecular weight of a resin constituting the core is preferably from about 3,000 to about 50,000, more preferably from about 5,000 to about 40,000. Within this range, both fixing properties and image strength after fixing become easy to obtain.

The weight-average molecular weight of a resin constituting the shell is preferably from about 3,000 to about 50,000, more preferably from about 5,000 to about 40,000. Within this range, both fixing properties and suppression of filming onto a photoreceptor are easy to obtain.

In order to attain the object of the invention, the content of the resin particles having the core-shell structure is preferably 20% by weight or more, more preferably in the range of from 30 to 98% by weight, still more preferably from 50 to 98% by weight, based on the total weight of the toner. In the case where the content is within the range, there result excellent pressure fixing properties, thus such content being preferred.

In the resin particles having the core-shell structure, the weight ratio of the resin constituting the core to the resin constituting the shell, core:shell, is preferably from about 10:90 to about 90:10, more preferably from about 15:85 to about 85:15. In the case when the ratio is within the range, there results excellent pressure fixing properties.

The ratio of the median diameter (center diameter) of the resin particles having the core-shell structure to the volume-average particle diameter of the toner is preferably from 1/10 to 1/1,000, more preferably from 1/5 to 1/1,000, still more preferably from 1/2 to 1/200. In the case when the ratio is within the range, it is easy to control toner particle diameter, thus such ratio being preferred.

Specifically, the median diameter of the resin particles having the core-shell structure is preferably from 0.01 to 1.0 μm, more preferably from 0.05 to 0.7 μm, still more preferably from 0.1 to 0.5 μm. In the case when the median diameter is within the range, the dispersing state of the resin particles in an aqueous medium becomes stable, thus such median diameter being preferred. Also, in the case when such particles are used for preparing a toner, it is easy to control particle diameter of the toner, and the resulting toner has excellent releasing properties and offset properties upon fixing, thus such particles being preferred.

Incidentally, the median diameter of the resin particles having the core-shell structure can be measured in a known manner by means of, for example, a laser diffraction particle size distribution measuring apparatus (LA-920; manufactured by Horiba Ltd.)

Also, the method for confirming that the toner particle contains two or more resin particles in number having the core-shell structure is not particularly limited, and there are illustrated a method of observing the cross section of the toner with a transmission type electron microscope, and a method of producing a distinct contrast by dyeing or the like and observing the cross section of the toner with a transmission type electron microscope. In some cases, it becomes apparent, based on the ratio of the toner particle diameter to the diameter of the resin particle having the core-shell structure upon production thereof, the amount of resin particles having the core-shell structure, and a production process, that two or more resin particles having the core-shell structure are contained in the toner particle.

The resin particles having the core-shell structure are preferably prepared by emulsion polymerization.

In emulsion polymerization, it is more preferred to employ a process, called a two-stage feed process, wherein a monomer is stepwise fed to a polymerization system. The two-stage feed process enables one to obtain with ease resin particles having the core-shell structure wherein the core and the shell are composed of resins different from each other in Tg.

When resin particles having the core-shell structure are mixed to prepare a toner under the conditions of high temperature and high pressure by using a kneading method as in the related art, there exists the risk that the precisely formed microscopic phase separation structure is destroyed, with intended baroplastic properties not being obtained. For this reason, too, a process of forming particles in an aqueous medium such as water is preferred as the process for producing the toner. In order to produce a toner by a dissolution suspension process or emulsion polymerization aggregation process using the thus-obtained resin as a binder resin, a conventionally known production process can be employed.

As the process for producing the resin particles having the core-shell structure wherein core and shell are composed of resins different from each other in Tg, there can be illustrated those processes which are described in Core-Shell Polymer Nanoparticles for Baroplastic Processing, *Macromolecules*, 2005, 38, 8036-8044; Preparation and Characterization of Core-Shell Particles Containing Perfluoroalkyl Acrylate in the Shell, *Macromolecules*, 2002, 35, 6811-6818; and Complex Phase Behavior of a Weakly Interacting Binary Polymer Blend, *Macromolecules*, 2004, 37, 5851-5855.

In the invention, of the binder resins to be used for the toner, those which can be produced by radical polymerization of a polymerizable monomer can be polymerized by using a radical polymerization initiator.

As the radical polymerization initiator to be used here, known ones can be used with no particular limitations. Specific examples of the radical polymerization initiator include peroxides such as hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethylbenzoyl peroxide, lauroyl peroxide, ammonium persulfate, sodium persulfate, potassium persulfate, diisopropyl peroxycarbonate, tetralin hydroperoxide, 1-phenyl-2-methylpropyl-1-hydroperoxide, pertriphenylacetic acid-tert-butyl-hydroperoxide, tert-butyl performate, tert-butyl peracetate, tert-butyl perbenzoate, tert-butyl phenylperacetate, tert-butyl methoxyperacetate, and tert-butyl N-(3-toluyl)percarbamate; azo compounds such as 2,2'-azobispropane, 2,2'-dichloro-2,2'-azobispropane, 1,1'-azo (methylethyl)diacetate, 2,2'-azobis(2-amidinopropane) hydrochloride, 2,2'-azobis(2-amidinopropane)nitrate, 2,2'-azobisisobutane, 2,2'-azobisisobutylamide, 2,2'-azobisisobutylonitrile, methyl 2,2'-azobis(2-methylpropionate), 2,2'-dichloro-2,2'-azobisbutane, 2,2'-azobis-2-methylbutylonitrile, dimethyl 2,2'-azobisisobutyrate, 1,1'-azobis(sodium 1-methylbutylonitrile- 3-sulfonate), 2-(4-methylphenylazo)-2-methylmalonodinitrile, 4,4'-azobis-4-cyanovaleric acid, 3,5-dihydroxymethylphenylazo-2-methylmalonodinitrile, 2-(4-bromophenylazo)-2-allylmalonodinitrile, 2,2'-azobis-2-methylvaleronitrile, dimethyl 4,4'-azobis(4-cyanovalerate), 2,2'-azobis-2,4-dimethylvaleronitrile, 1,1'-azobiscyclohexanenitrile, 2,2'-azobis-2-propylbutylonitrile, 1,1'-azobis-1-chlorophenylethane, 1,1'-azobis-1-cyclohexanecarbonitrile, 1,1'-azobis-1-cycloheptanenitrile, 1,1'-azobis-1-phenylethane, 1,1'-azobiscumene, ethyl 4-nitrophenylazobenzylcyanoacetate, phenylazodiphenylmethane, phenylazotriphenylmethane, 4-nitrophenylazotriphenylmethane, 1,1'-azobis-1,2-diphenylethane, poly(bisphenol A-4,4'-azobis-4-cyanopentanoate), poly(tetraethyleneglycol-2,2'-azobisisobutylate) and 2,2'-azobis(2-methylpropionamidine) dihydrochloride; 1,4-bis(pentaethylene)-2-tetrazene; and 1,4-dimethoxycarbonyl-1,4-diphenyl-2-tetrazene.

Polymerization of the monomer which constitutes the resin for forming particles having the core-shell structure is preferably conducted in an aqueous medium.

Examples of the aqueous medium which can be used in the invention include water such as distilled water or deionized water; alcohols such as ethanol and methanol; and a mixture of the water and the alcohol. Of these, ethanol, water, or a mixture thereof is preferred, with water such as distilled water or deionized water being particularly preferred. These may be used independently or in combination of two or more thereof.

Also, the aqueous medium may contain a water-miscible organic solvent. Examples of the water-miscible organic solvent include acetone and acetic acid. In the invention, an embodiment is preferred wherein no water-miscible organic solvent is contained.

Also, the polymerization reaction may be conducted in an organic solvent.

Specific examples of the organic solvent which can be used in the invention include hydrocarbons such as toluene, xylene, and mesitylene; halogen-containing solvents such as chlorobenzene, bromobenzene, iodobenzene, dichlorobenzene, 1,1,2,2-tetrachloroethane, and p-chlorotoluene; ketone series solvents such as 3-hexanone, acetophenone, and benzophenone; ether series solvents such as dibutyl ether, anisole, phenetole, o-dimethoxybenzene, p-dimethoxybenzene, 3-methoxytoluene, dibenzyl ether, benzyl phenyl ether, methoxynaphthalene, and tetrahydrofuran; thioether series solvents such as phenyl sulfide and thioanisole; ester series solvents such as ethyl acetate, butyl acetate, pentyl acetate, methyl benzoate, methyl phthalate, ethyl phthalate, cellosolve acetate; and diphenyl ether series solvents such as diphenyl ether, alkyl-substituted diphenyl ethers (e.g., 4-methyldiphenyl ether, 3-methyldiphenyl ether, and 3-phenoxytoluene), halogen-substituted diphenyl ethers (e.g., 4-bromodiphenyl ether, 4-chlorodiphenyl ether, 4-bromodiphenyl ether, and 4-methyl-4'-bromodiphenyl ether), alkoxy-substituted diphenyl ethers (e.g., 4-methoxydiphenyl ether, 3-methoxydiphenyl ether, and 4-methyl-4'-methoxydiphenyl ether), and cyclic diphenyl ethers (e.g., dibenzofuran and xanthene) These solvents may be used as a mixture thereof.

Also, in the production of a binder resin by polymerizing in an aqueous medium, as a method for forming an emulsion of monomer particles, there can be illustrated, for example, a method of uniformly mixing a monomer solution (oil phase) containing a co-surfactant with an aqueous medium solution (aqueous phase) of a surfactant in a shear mixing apparatus such as a piston homogenizer, amicrofluidizing apparatus (e.g., MICROFLUIDIZER manufactured by Microfluidix), or an ultrasonic wave dispersing apparatus to thereby prepare an emulsion. In this occasion, the charging amount of the oil phase is preferably from about 0.1 to about 50% by weight based on the total weight of the aqueous phase and the oil phase. The amount of the surfactant to be used is preferably less than the critical micelle concentration (CMC) in the presence of the formed emulsion, and the amount of the co-surfactant to be used is preferably from 0.1 to 40 parts by weight, more preferably from 0.1 to 20 parts by weight, per 100 parts by weight of the oil phase.

Incidentally, as described hereinbefore, in "miniemulsion polymerization process" wherein the monomer is polymerized in the presence of a polymerization initiator for the monomer emulsion using a surfactant in a concentration less than the critical micelle concentration (CMC) and a co-surfactant in combination, polymerization of the addition-polymerizable monomer proceeds within monomer particles (oil droplets) to form uniform polymer particles, thus such process being preferred. Further, in the invention, even with a polycondensation/addition polymerization composite polymer, "miniemulsion polymerization process" does not require diffusion of the monomer during the polymerization process, and hence the plycondensation polymer has the advantage that it can remain as such within the particles.

Also, so-called "microemulsion polymerization process" of producing particles of from 5 to 50 nm in particle diameter, described in, for example, J. S. Guo, M. S. El-Aasser, J. W. Vanderhoff; *J. Polym. Sci.*; Polym. Chem. Ed., vol. 27, p. 691 (1989), provide the same dispersion structure and the same polymerization mechanism as with the "miniemulsion polymerization process" in the invention, and can be used in the invention. In the "microemulsion polymerization process", the surfactant is used in a larger amount than the critical micelle concentration (CMC), and hence there might arise such problem as that the resulting polymer particles are contaminated with a large amount of the surfactant, or that an enormous time is required for removing the surfactant by washing with water, acid, or alkali.

Further, in the case of conducting polycondensation and/or polymerization in an aqueous medium in the production of the binder resin, use of a co-surfactant is preferred. The co-surfactant is more preferably used in an amount of from 0.1 to 40% by weight based on the total weight of the monomer(s). The co-surfactant is added for the purpose of reducing Ostwald ripening in the so-called miniemulsion polymerization. As the co-surfactant, those generally known as co-surfactants for the miniemulsion process may be used.

Preferred examples of the co-surfactant include, but are not limited to, alkanes having carbon atoms of from 8 to 30, such as dodecane, hexadecane, and octadecane; alkyl alcohols having carbon atoms of from 8 to 30, such as lauryl alcohol, cetyl alcohol, and stearyl alcohol; alkyl mercaptans having carbon atoms of from 8 to 30, such as lauryl mercaptan, cetyl mercaptan, and stearyl mercaptan; a polymer thereof with acrylic acid esters or methacrylic acid esters; a polymer or polyadducts, such as polystyrene and polyester; carboxylic acids; ketones; and amines.

Among these co-surfactants, those which are preferably used are hexadecane, cetyl alcohol, stearyl methacrylate, lauryl methacrylate, polyester, and polystyrene and, for the purpose of avoiding generation of a volatile organic substance, stearyl methacrylate, lauryl methacrylate, polyester, and polystyrene are more preferred.

The polymer or polymer-containing composition usable for the co-surfactant may contain, for example, a copolymer, block copolymer or mixture with another monomer. Also, a plurality of co-surfactants may be used in combination thereof.

The co-surfactant may be used in either of the oil phase and the aqueous phase.

Other Binder Resins

In the invention, the toner permits use of other binder resin, as a binder resin, than the resin particles having the core-shell structure.

The content of the core-shell particles in this occasion is preferably 30% by weight or more, based on the weight of the total binder resins used for the toner, for the purpose of attaining the object. The content is more preferably in the range of from 40 to 100% by weight, with the range of from 50 to 100% by weight being still more preferred.

Preferred examples of the other binder resin include ethylene siries resins, styrene series resins, polymethyl(meth)acrylate, (meth)acryl resins, polyamide resins, polycarbonate resins, polyether resins, polyester resins, and copolymer resins thereof, with styrene series resins, (meth)acryl resins, polyester resins, and copolymer resins thereof being more preferred.

As the polyester resin, there can be preferably illustrated polyesters other than the polyester block copolymer having a weight-average molecular weight of 3,000 or less and containing a non-crystalline polyester block containing a cyclic structure in the main chain and a crystalline polyester block containing no cyclic structure in the main chain. The polyester resin can be synthesized by a conventionally known method such as those described in *Jushukugo* (Polycondensation) (Kagaku Dojin, 1971), *Kobunshi Jikkengaku* (*Jushukugo to Jufuka*) [(High Polymer Experiment) (Polycondensation and polyaddition)], (Kyoritsu Shuppan, 1958), or *Poriesuteru Jushi Handobukku* (Polyester Resin Handbook), (Nikkan Kogyo Shinbunsha, 1988). The ester exchange method or direct polycondensation method may be employed either alone or in combination.

Also, as other binder resins which can be used in the invention, addition polymerization type resins other than those resins which are used for the resin particles having the core-shell structure are useful. Examples of addition-polymerizable monomers for preparing such addition polymerization type resins include radical-polymerizabie monomers, cation-polymerizable monomers, and anion-polymerizable monomers.

Releasing Agent

The electrostatic-image-developing toner of the invention contains a releasing agent composed of a polyester block copolymer having a weight-average molecular weight of 3,000 or less and containing a non-crystalline polyester block containing a cyclic structure in the main chain and a crystalline polyester block containing no cyclic structure in the main chain.

The releasing agent is usually synthesized by polycondensation using a polyacid and a polyalcohol. It is particularly effective for the releasing agent to have a block including a non-crystalline polycondensation product containing a cyclic structure such as an aromatic ring structure (e.g., a bisphenol A derivative) in the main chain and a block including a crystalline polycondensation product of an aliphatic acid and an aliphatic alcohol and containing no cyclic structure in the main chain.

For example, the releasing agent can be obtained by forming an oligomer including a bisphenol A ethylene oxide adduct and terephthalic acid or the like, simultaneously preparing a polycondensation oligomer including an aliphatic acid and an aliphatic alcohol, and mixing them to thereby advance the polycondensation. However, when the molecular weight of the polycondensation product is too high, there results insufficient fluidity upon application of pressure, thus the intended effect not being obtained.

Polycondensable Monomer

The polyvalent carboxylic acids which can be used in the invention are compounds containing two or more carboxyl groups per molecule.

Of them, dicarboxylic acids are compounds having two carboxyl groups per molecule, and examples thereof include oxalic acid, glutaric acid, succinic acid, maleic acid, adipic acid, β-methyl-adipic acid, azelaic acid, sebacic acid, nonanedicarboxylic acid, decanedicarboxylic acid, undecanedicarboxylic acid, dodecanedicarboxylic acid, fumaric acid, citraconic acid, diglycolic acid, cyclohexane-3,5-diene-1,2-dicarboxylic acid, malic acid, citric acid, hexahydroterephthalic acid, malonic acid, pimelic acid, tartaric acid, mucic acid, phthalic acid, isophthalic acid, terephthalic acid, tetrachlorophthalic acid, chlorophthalic acid, nitrophthalic acid, p-carboxyphenyl-acetic acid, p-phenylenediacetic acid, m-phenylenediglycollic acid, p-phenylenediglycollic acid, o-phenylenediglycollic acid, diphenylacetic acid, diphenyl-p,p'-dicarboxylic acid, naphthalene-1,4-dicarboxylic acid, naphthalene-1,5-dicarboxylic acid, naphthalene-2,6-dicarboxylic acid, anthracenedicarboxylic acid, and cyclohexanedicarboxylic acid. As polyvalent carboxylic acids other than divalent carboxylic acids, there can be illustrated trimellitic acid, pyromellitic acid, naphthalenetricarboxylic acid, naphthalenetetracarboxylic acid, pyrenetricarboxylic acid, and pyrenetetracarboxylic acid. Also, compounds in which a carboxyl group of these carboxylic acids is derived to an acid anhydride, a mixed acid anhydride, an acid chloride or an ester may be used.

Polyols which can be used in the invention are compounds having two or more hydroxyl groups per molecule. Of these compounds, diol is a compound having two hydroxyl groups per molecule, and examples thereof include ethylene glycol, propylene glycol, butanediol, diethylene glycol, hexanediol, cyclohexanediol, octanediol, decanediol, and dodecanediol. As polyols other than diols, there can be illustrated, for example, glycerol, pentaerythritol, hexamethylolmelamine, hexaethylolmelamine, and tetramethylolbenzoguanamine, tetraethylolbenzoguanamine.

Since these polyols are scarcely soluble or insoluble in an aqueous medium, the ester-synthesizing reaction proceeds in monomer droplets of the polyol dispersed in the aqueous medium.

Also, examples of hydroxycarboxylic acid which can be used in the invention as a polycondensable monomer for the polyester include hydroxyheptanoic acid, hydroxyoctanoic acid, hydroxydecanoic acid, and hydroxyundecanoic acid.

Regarding polyesters which can be used in the invention, non-crystalline polyesters and crystalline polyesters can readily be obtained by properly combining these polycondensable monomers.

Examples of polyvalent carboxylic acids which can preferably be used for obtaining a crystalline polyester containing no cyclic structure in the main chain include oxalic acid, malonic acid, succinic acid, glutaric acid, adipic acid, pimelic acid, suberic acid, azelaic acid, sebacic acid, maleic acid, fumaric acid, citraconic acid, itaconic acid, glutaconic acid, n-dodecylsuccinic acid, n-dodecenylsuccinic acid, isododecylsuccinic acid, isododecenylsuccinic acid, n-octylsuccinic acid, n-octenylsuccinic acid, denanedicarboxylic acid, and anhydrides orchlorides of these acids.

Also, examples of the polyols to be used for obtaining the crystalline polyesters containing no cyclic structure in the main chain include ethylene glycol, diethylene glycol, triethylene glycol, 1,2-propylene glycol, 1,3-propylene glycol, 1,4-butanediol, 1,4-butenediol, neopentyl glycol, 1,5-pentaneglycol, 1,6-hexane glycol, dipropylene glycol, polyethylene glycol, and polypropylene glycol.

Also, crystalline polyesters obtained by ring opening polymerization of a cyclic monomer such as caprolactone are preferred because they have a melting temperature at around 60° C. which is appropriate as a toner.

As the crystalline polycondensation resins containing no cyclic structure in the main chain, there can be illustrated a polyester obtained by reacting 1,9-nonanediol with 1,10-decanedicarboxylic acid or by reacting cyclohexanediol with adipic acid, a polyester obtained by reacting 1,6-hexanediol with sebacic acid, a polyester obtained by reacting ethylene glycol with succinic acid, a polyester obtained by reacting ethylene glycol with sebacic acid, and a polyester obtained by reacting 1,4-butanediol with succinic acid.

Of these, a polyester obtained by reacting 1,9-nonanediol with 1,10-decanedicarboxilic acid and a polyester obtained by reacting 1,6-hexanediol with sebacic acid are more preferred.

Non-Crystalline Polyester Containing a Cyclic Structure in the Main Chain

In the case of obtaining non-crystalline polyester containing a cyclic structure in the main chain by polycondensation of a polyvalent carboxylic acid and a polyhydric alcohol, it is preferred that at least part of the polyvalent carboxylic acid or at least part of the polyhydric alcohol, or both of them, contains a cyclic structure, and it is more preferred that both of the polyvalent carboxylic acid and the polyhydric alcohol contain a cyclic structure.

The cyclic structure may be a group containing a cyclic structure and can preferably be exemplified by an aromatic ring and an alicyclic hydrocarbon.

Examples of the polyvalent carboxylic acid to be used in the invention for obtaining the crystalline polyester containing a cyclic structure in the main chain include dicarboxylic acids such as phthalic acid, isophthalic acid, terephthalic acid, tetrachlorophthalic acid, chlorophthalic acid, nitrophthalic acid, p-carboxyphenylacetic acid, pphenylenediacetic acid m-phenylenediglycolic acid, p-phenylenediglycolic acid, o-phenylenediglycolic acid, diphenylacetic acid, diphenyl-p, p'-dicarboxylic acid, naphthalene-1,4-dicarboxylic acid, naphthalene-1,5-dicarboxylic acid, naphthalene-2,6-dicarboxylic acid, anthracene dicarboxylic acid, and cyclohexanedicarboxylic acid. Examples of the polyvalent carboxylic acid other than the dicarboxylic acid include trimellitic acid, pyromellitic acid, naphthalenetricarboxylic acid, naphthalenetetracarboxylic acid, pyrenetricarboxylic acid, and pyrenetetracarboxylic acid. Also, derivatives of these carboxylic acids wherein the carboxyl group is converted to acid anhydride, acid chloride or ester may be used as well.

Of these, terephthalic acid and a lower alkyl ester thereof, diphenylacetic acid, and cyclohexanedicarboxylic acid are preferably used. Incidentally, the term "lower alkyl ester" as used herein means an ester with an aliphatic alcohol having from 1 to 8 carbon atoms.

Also, as polyols to be used in the invention for obtaining non-crystalline polyester containing a cyclic structure in the main chain, polytetramethylene glycol, bisphenol A, bisphenol Z, hydrogenated bishenol A, cyclohexanediol, and cyclohexanedimethanol are preferably used.

The polyvalent carboxylic acids and the polyols may respectively be used independently, or either the polyvalent carboxylic acids or the polyols may be used independently, with the other being used in combination of two or more thereof or, further, both may respectively be used in combination of two or more thereof, for preparing one kind of a polycondensation resin. Also, in the case of using hydroxycarboxylic acids for preparing a polycondensation resin, one or two or more kinds of the hydroxycarboxylic acids may be used and, further, a polyvalent carboxylic acid or a polyol may be used together.

In the block copolymer, the weight ratio of the crystalline polyester block containing no cyclic structure in the main chain to the non-crystalline polyester block containing a cyclic structure in the main chain, i.e., crystalline polyester block containing no cyclic structure in the main chain/non-crystalline polyester block containing a cyclic structure in the main chain, is preferably from about 1/20 to about 20/1, more preferably from about 1/10 to about 10/1 . Further, a ratio of from about 1/9 to about 5/5 is still more preferred since it serves to suppress deterioration of the charging properties of the resulting toner due to the crystalline polyester containing no cyclic structure in the main chain. In the case when the ratio of the crystalline polyester block containing no cyclic structure in the main chain to the non-crystalline polyester block containing a cyclic structure in the main chain is within the above-described ranger there results a block copolymer which can impart sufficient charging properties and mechanical strength and, further, fixing properties at a low temperature, to the prepared toner, thus such ratio being preferred. Further, the resulting toner is excellent in fluid behavior under pressure, hence such ratio being preferred.

In the block copolymer of the invention, the unit ratio of the crystalline polyester block containing no cyclic structure in the main chain to the non-crystalline polyester block containing a cyclic structure in the main chain is preferably such that the block copolymer is a diblock copolymer which includes one crystalline polyester block containing no cyclic structure in the main chain and one non-crystalline polyester block containing a cyclic structure in the main chain.

In the case of obtaining the block copolymer through high polymerization reaction by mixing a crystalline polyester resin containing no cyclic structure in the main chain with a non-crystalline polyester resin containing a cyclic structure in the main chain, the crystalline polyester resin containing no cyclic structure in the main chain has a crystal melting temperature of preferably from about 40° C. to about 150° C., more preferably from about 50° C. to about 120° C., particularly preferably from about 50° C. to about 90° C. In the case when the crystal melting temperature of the crystalline resin to be used is within the range, the resulting toner has excellent blocking resistance, shows excellent melt flowing properties at a low temperature, and exhibits excellent fixing properties, thus such crystal melting temperature being preferred.

The melting temperature of the crystalline polyester containing no cyclic structure in the main chain can be measured according to a differential scanning calorimetry (DSC) using, for example "DSC-20" (manufactured by Seiko Electronic Industrial Co., Ltd.). Specifically, the melting temperature can be found as the melting peak temperature obtained by measuring an about 10 mg sample according to input compensation differential scanning calorimetry shown in JIS K-7121:87 with increasing the temperature from room temperature to 150° C. at a temperature increasing rate of 10° C. per minute. There are cases where crystalline resins show a plurality of melting peaks. In the invention, the maximum peak is regarded as melting temperature.

On the other hand, in the case of obtaining the block copolymer through high polymerization reaction by mixing a crystalline polyester resin containing no cyclic structure in the main chain with a non-crystalline polyester resin containing a cyclic structure in the main chain, the non-crystalline polyester resin containing a cyclic structure in the main chain has a glass transition temperature Tg of preferably from 50 to 80° C., more preferably from 50 to 65° C. In the case when Tg is 50° C. or higher, the resulting binder resin itself acquires excellent aggregating force in the high-temperature region, hot offset phenomenon scarcely occurs upon fixing and, at a temperature of 80° C. or lower, sufficient melting occurs with no increase in the lowest fixing temperature, thus such Tg being preferred.

Here, the glass transition temperature of the non-crystalline resin means a value obtained by measuring according to the method provided in ASTM D3418-82 (DSC method).

The glass transition temperature in the invention can be measured according to, for example, a differential scanning calorimetry (DSC) using, for example "DSC-20" (manufactured by Seiko Electronic Industrial Co., Ltd.). Specifically, the glass transition temperature can be obtained by heating an about 10 mg sample at a rate of 10° C./min and reading the point of intersection between the base line and the inclined line of the endothermic peak.

Also, in the invention, the glass transition temperature of the block copolymer is preferably from 50 to 80° C., more preferably from 50 to 65° C. In the case when the glass transition temperature of the block copolymer is within the range, caking of the resulting toner scarcely occurs, and storing properties of the toner are excellent, thus such glass transition temperature being preferred.

Also, the melting temperature of the block copolymer is preferably from 50 to 100° C., more preferably from 50 to 80° C. In the case when the melting temperature of the block copolymer is within the range, fixing properties on thick paper, charging properties, and filming resistance onto a photoreceptor are liable to be obtained with ease, thus such melting temperature being preferred.

Incidentally, with some of the block copolymers, distinct melting temperature and distinct glass transition temperature are not observed.

In the case of obtaining the block copolymer through high polymerization reaction by mixing a crystalline polyester resin containing no cyclic structure in the main chain with a non-crystalline polyester resin containing a cyclic structure in the main chain, the crystalline polyester resin containing no cyclic structure in the main chain has a weight-average molecular weight of preferably from 700 to 2,000, more preferably from 1,000 to 1,500.

Also, the non-crystalline polyester resin containing no cyclic structure to be mixed has a weight-average molecular weight of from 700 to 2,000, more preferably from 1,000 to 1,500.

In the invention, the block copolymer has a weight-average molecular weight of 3,000 or less, more preferably 2,500 or less. In case when the weight-average molecular weight exceeds 3,000, releasing properties upon fixing are not obtained. Also, the weight-average molecular weight is preferably 500 or more, more preferably 1,000 or more. In the case when the weight-average molecular weight is 500 or more, solidification does not occur during transportation, and fixed images do not give sticky feeling, thus such weight-average molecular weight being preferred.

Also, the block copolymer which can be used in the invention may partially have a branched or cross-linked structure formed by selecting the number of carboxyl groups or the number of hydroxyl groups of the monomers or by adding a cross-linking agent.

The median diameter (center diameter) of the releasing agent particles is preferably from 0.05 to 2.0 μm, more preferably from 0.1 to 1.0 μm, still more preferably from 0.1 to 0.5 μm. In the case when the median diameter is within the range, the state of the dispersion of the releasing agent particles in an aqueous medium becomes stable, thus such median diameter being preferred.

In the invention, the releasing agent including a polyester block copolymer having a weight-average molecular weight of 3,000 or less and containing a non-crystalline polyester block containing a cyclic structure in the main chain and a crystalline polyester block containing no cyclic structure in the main chain is incorporated in the toner in a content of preferably from 1 to 30% by weight, more preferably from 10 to 20% by weight. In the case when the content is within the range, there results a toner having excellent releasing properties upon fixing.

The crystalline polyester resin containing no cyclic structure and the non-crystalline polyester resin containing a cyclic structure can be produced by conducting polycondensation reaction between the polyhydric alcohol and the polyvalent carboxylic acid in a conventional manner. This polycondensation reaction can be conducted according to a common polycondensation process such as bulk polymerization, emulsion polymerization, or suspension polymerization, with bulk polymerization being preferred. Also, the reaction may be conducted under an atmospheric pressure, but common conditions such as a condition under reduced pressure or a condition in a nitrogen stream may also be employed.

Specifically, the resins can be produced in a manner as follows: the polyhydric alcohol, the polyvalent carboxylic acid and, as needed, a catalyst are placed in a reaction vessel equipped with a thermometer, a stirrer, and a falling condenser, and the mixture is heated in the presence of an inert gas (e.g., nitrogen gas), with continuously removing by-produced low molecular compounds out of the reaction system, and then the reaction is discontinued at the point where the molecular weight of the product reaches a predetermined degree, followed by cooling and collecting an intended reaction product.

Additionally, at least either of the crystalline polyester resin containing no cyclic structure in the main chain and the non-crystalline polyester resin containing a cyclic structure in the main chain is preferably a resin produced in the presence of a sulfur acid catalyst at a temperature of 150° C. or less and, more preferably, both resins are resins produced by polymerizing in the presence of a sulfur acid catalyst at a temperature of 150° C. or less.

Further, the block copolymer is preferably obtained by adding a sulfur acid catalyst as a catalyst to the crystalline polyester resin containing no cyclic structure in the main chain and the non-crystalline polyester resin containing a cyclic structure in the main chain, and heating at a temperature of 150° C. or less. The reaction temperature is preferably from 70 to 150° C., more preferably from 80 to 140° C. In the case when he reaction temperature is 70° C. or more, reduction of reactivity due to solubility of the monomer and due to reduction of the catalyst activity does not occur, and elongation of the molecule is not suppressed, thus such reaction temperature being preferred. Also, in the case when the reaction temperature is 150° C. or less, the production can be performed at a low energy cost. Further, coloration of the resulting resin and decomposition of the produced polyester do not occur.

Sulfur Acid Catalyst

Examples of the sulfur acid catalyst to be used include an alkylbenzenesulfonic acid (e.g., dodecylbenzenesulfonic acid, isopropylbenzenesulfonic acid, or comphorsulfonic acid), an alkylsulfonic acid, an alkyldisulfonic acid, an alkylphenolsulfonic acid, an alkylnaphthalenesulfonic acid, an alkyltetralinsulfonic acid, an alkylallylsulfonic acid, a petroleum sulfonic acid, an alkylbenzimidazolesulfonic acid, a higher alcohol ether sulfonic acid, an alkyldiphenylsulfonic acid, monobutylphenylphenol sulfuric acid, dibutyl-phenylphenol sulfuric acid, an higher fatty acid sulfuric acid ester (e.g., dodecylsulfuric acid), a higher alcohol sulfuric ester, a higher alcohol ether sulfuric acid ester, a higher fatty acid amide alkylolsulfuric acid ester, a higher fatty acid amide alkylated sulfuric acid ester, naphthenyl alcohol sulfuric acid, a sulfated fat, a sulfosuccinic acid ester, a sulfonated higher fatty acid, a resin acid alcohol sulfuric acid, and salt compounds of all of these, which, however, are not limitative at all. Further, these catalysts may have some functional groups in their structures. A plurality of these catalysts may be used in combination thereof as needed. As a sulfur acid catalyst which is preferably used, alkylbenzenesulfonic acids can be illustrated. Of them, dodecylbenzenesulfonic acid, benzenesulfonic acid, p-toluenesulfonic acid, comphorsulfonic acid, etc. are particularly preferred.

Together with the above-described catalysts, commonly employed other polycondensation catalysts may be used as well. Specific examples thereof include metal catalysts, hydrolysis enzyme type catalysts, basic catalysts, and sulfur acid-free Brønsted acid catalysts.

Other Releasing Agents

In the invention, other releasing agents than the releasing agent including a polyester block copolymer having a weight-average molecular weight of 3,000 or less and containing a non-crystalline polyester block containing a cyclic structure in the main chain and a crystalline polyester block containing no cyclic structure in the main chain may further be added, as needed, to the toner.

Specific examples of the other releasing agents include a low molecular polyolefin such as polyethylene, polypropylene, or polybutene; a long-chain fatty acid such as palmitic acid; a silicone showing a softening temperature upon being heated; an fatty acid amide such as oleic acid amide, erucic acid amide, ricinoleic acid amide, or stearic acid amide; plant waxes such as carnauba wax, rice wax, candelilla wax, Japanese wax, and jojoba oil; animal waxes such as bee wax; mineral-petroleum waxes such as montan wax, ozokerite, ceresin, paraffin wax, microcrystalline wax, and Fischer-Tropsch wax; ester waxes such as fatty acid ester, montanic acid ester, and carboxylic acid ester. In the invention, these releasing agents may be used independently or in combination of two or more thereof.

The addition amount of the releasing agent is preferably from 1 to 20% by weight, more preferably from 5 to 15% by weight, based on the total weight of the toner particles. In the case when the addition amount is within the range, there can be obtained sufficient effects of the releasing agent and, since resulting toner particles within a developing device are scarcely destroyed, the releasing agent is not spent to the carrier, and charging properties are not deteriorated, thus such addition amount being preferred.

Charge Controlling Agent

In the invention, a charge controlling agent may be added, as needed, to the toner. As the charge controlling agent, known ones may be used. For example, azo series metal complex compounds, metal complex compounds of salicylic acid, and polar group-containing resin type charge controlling agents may be used. In the case of producing the toner according to a wet production process, use of a material difficultly soluble in water is preferred in view of controlling ion strength (%) and reduction of pollution with waste water. Incidentally, in the invention, the toner may be either of a magnetic toner containing a magnetic material and a non-magnetic toner containing no magnetic material.

Colorant

The colorants which can be used in the invention are not particularly limited, and examples thereof include known colorants, with a proper one being properly selected according to the purpose. The colorants may be used independently or in combination of two or more of the same series colorants. Further, two or more different series colorants may also be used as a mixture thereof. Still further, these colorants may be surface-treated before use.

As specific examples of the colorants, there can be illustrated black, yellow, orange, red, blue, purple, green, and white series colorants as shown below.

Examples of black pigment include organic and inorganic colorants such as carbon black, aniline black, activated carbon, non-magnetic ferrite, and magnetite.

Examples of yellow pigment include lead yellow, zinc yellow, yellow calcium oxide, cadmium yellow, chrome yellow, fast yellow, fast yellow 5G, fast yellow 5GX, fast yellow 10G, benzidine yellow G, benzidine yellow GR, threne yellow, quinoline yellow, and permanent yellow NCG.

Examples of orange pigment include reddish yellow lead, molybdenum orange, permanent orange GTR, pyrazolone orange, vulcan orange, benzidine orange G, indathrene brilliant orange RK, and indathrene brilliant orange GK.

Examples of red pigment include red iron oxide, cadmium red, red lead, mercury sulfide, Watchung red, permanent red 4R, lithol red, brilliant carmine 3B, brilliant carmine 6B, Du pont oil red, pyrazolone red, rhodamine B lake, lake red C, rose bengale, eoxine red, and alizarine lake.

Examples of blue pigment include organic and inorganic colorants such as prussian blue, cobalt blue, alkali blue lake, victoria blue lake, fast sky blue, indathrene blue BC, ultramarine blue, phthalocyanine blue, and phthalocyanine green.

Examples of purple pigment include organic and inorganic colorants such as manganese violet, fast violet B, and methyl violet lake.

Examples of green pigment include organic and inorganic colorants such as chromium oxide, chromium green, pigment green B, malachite green lake, and final yellow green G.

Examples of white pigment include zinc oxide, titanium oxide, antimony white, and zinc sulfide.

Examples of extender pigment include barytes powder, barium carbonate, clay, silica, white carbon, talc, and alumina white.

In the invention, the colorant in the toner can be dispersed in a binder resin using a known method. In the case when the toner is obtained by the knead-pulverizing method, the colorant may be used as such, or so-called master batch may be used wherein the colorant is previously dispersed in a resin in a high concentration and, upon kneading, is kneaded together with a binder resin. Further, a flushing method may also be employed wherein the synthesized colorant is dispersed in a resin in a state of wet cake before being dried.

The colorant may be used as such for preparing a toner by the suspension polymerization process. In the suspension polymerization process, the colorant can be dispersed in the resulting particles by dissolving or dispersing in a polymerizable monomer the colorant dispersed in a resin.

When the toner-producing process is an emulsion polymerization aggregation process, a toner can be obtained by dispersing the colorant in an aqueous medium together with a dispersing agent such as a surfactant by applying thereto mechanical impact to thereby prepare a colorant dispersion, and then causing aggregation together with the resin particles to form particles of the toner particle size.

As specific examples of dispersing by applying mechanical impact or the like, there are illustrated, for example, methods of preparing a dispersion of colorant particles by using a revolving shearing homogenizer, a media type disperser such as a ball mill, a sand mill, or an attritor, or a high pressure counter collision type disperser. These colorants can also be dispersed in an aqueous system by using a polar surfactant and applying mechanical impact such as a homogenizer.

In order to ensure coloring properties upon fixing, the colorant is added in an amount of preferably from 4 to 15% by weight, more preferably from 4 to 10% by weight, based on the total weight of solid components of the toner. However, in the case of using a magnetic material as a black colorant, it is added in an amount of preferably from 12 to 48% by weight, more preferably from 15 to 40% by weight. Toners of various colors such as a yellow toner, a magenta toner, a cyan toner, a black toner, a white toner, and a green toner can be obtained by properly selecting the kinds of the colorants.

Magnetic Material

In the invention, the toner may contain a magnetic material as needed.

Examples of the magnetic material include metals or alloys exhibiting ferromagnetism, such as iron, cobalt and nickel including ferrite and magnetite, compounds containing these elements, alloys which contain no ferromagnetic element, but come to exhibit ferromagnetism by appropriate heat treatment, for example, an alloy called a "Heusler alloy" containing manganese and copper, such as manganese-copper-aluminum or manganese-copper-tin, chromium dioxide, and the like. For example, when obtaining a black toner, magnetite which is black itself and also fulfills a function as a colorant can be particularly preferably used. Further, when obtaining a color toner, a colorant which is less blackish such as metallic iron is preferred. Still further, of these magnetic materials, some act as a colorant. In that case, they may be used both as the magnetic material and the colorant. When obtaining the magnetic toner, the content of the magnetic material is preferably from 20 to 70 parts by weight, more preferably from 40 to 70 parts by weight, per 100 parts by weight of the toner.

Internal Additives

In the invention, internal additives may be added to the inside of the toner. The internal additives are generally used for the purpose of controlling viscoelasticity of a fixed image.

Specific examples of the internal additives include inorganic particles such as silica or titania, and organic particles such as polymethylmethacrylate. Also, in order to enhance dispersing properties, the additives may be surface-treated. The internal additives may be used independently or in combination of two or more thereof.

External Additives

In the invention, an external additive such as a fluidizing agent and a charge controlling agent may be added to the toner of the invention.

As the external additive, known materials may be used, and examples of the external additive include inorganic particles having been treated with a silane coupling agent on the surface thereof, such as silica particles, titanium oxide particles, alumina particles, cerium oxide particles, and carbon black, polymer particles such as polycarbonate, polymethyl methacrylate, and a silicone resin, a metal salt of amine, and a metal complex of salicylic acid. The external additives to be used in the invention may be used independently or in combination of two or more thereof.

In the invention, the cumulative volume average diameter $D_{50}$ of the electrostatic-image-developing toner is preferably from 3.0 to 9.0 μm, more preferably from 3.0 to 7.0 μm. When $D_{50}$ is 3.0 μm or more, adhesive force is moderate, developability is good, thus such average diameter being preferred. Also, when $D_{50}$ is 9.0 μm or less, image dissolution properties are excellent, thus such average diameter being preferred.

Also, the volume average particle size distribution index (GSDv) of the electrostatic-image-developing toner of the invention is preferably 1.30 or less. When the GSDv is 1.30 or less, resolution is excellent, scattering of the toner and fogging scarcely occur, and image defects scarcely occur, thus such GSDv being preferred.

In the invention, for the cumulative volume average diameter $D_{50}$ and the average particle size distribution index as used herein, a cumulative distribution curve is drawn from the smaller size side for each of the volume and the number of toner particles classified according to a particle size range (channel) divided based on the particle size distribution measured, for example, by a measuring equipment such as Coulter Counter TAII (manufactured by Beckmann Coulter) or Multisizer II (manufactured by Beckmann Coulter); and the particle sizes at an accumulation of 16% are defined as $D_{16v}$ for the volume and $D_{16p}$ for the number, the particle sizes at an accumulation of 50% are defined as $D_{50v}$ for the volume and $D_{50p}$ for the number, and the particle sizes at an accumulation of 84% are defined as $D_{84v}$ for the volume and $D_{84p}$ for the number. The volume average particle size distribution index (GSDv) is calculated as $(D_{84v}/D_{16v})^{1/2}$, and the number average particle size distribution index (GSDp) is calculated as $(D_{84p}/D_{16p})^{1/2}$ by using these values.

The shape factor SF1 of the toner is preferably from 110 to 140, more preferably from 120 to 140. It is known that, in the transfer step in the electropotographic process, a more spherical toner is more easily transferred and, in the cleaning step, a more amorphous toner is more easily cleaned.

SF1 is a shape factor showing the degree of unevenness on the surface of toner particles, and can be calculated in the following manner. The toner shape factor SF1 is a value obtained by incorporating optical microscope images of the toner particles spread on a slide glass into a Luzex image analyzer through a video camera, calculating SF1 of the following equation for 50 or more toner particles from a square of the maximum length of toner particles/projection area $((ML)^2/A)$, and determining the average value thereof.

$$SF1=((ML)^2/A)\times(\pi/4)\times 100 \quad \text{[Sushiki 1]}$$

wherein ML represents the maximum length of the toner particles, and A represents the projection area of the toner particles.

II. Process for Producing an Electrostatic-Image-Developing Toner

In the invention, as a process for producing the toner, there can be illustrated a process for producing a toner from a resin particle dispersion obtained by using a binder resin, i.e., a process for producing a toner by so-called chemical production process. In the invention, the toner is preferably a polymerization toner.

In the invention, the process for producing a toner is not particularly limited, and known processes such as a knead-pulverizing process, an aggregation coalescence process, and a suspension polymerization process may be employed. Of these, an aggregation coalescence process is preferred, with an emulsion polymerization aggregating process being particularly preferred.

The process of the invention for producing an electrostatic-image-developing toner involves including a dispersing step of dispersing the resin particles and the releasing agent particles in an aqueous medium, an aggregating step of aggregating the dispersed resin particles and releasing agent particles to obtain aggregated particles, and a fusing step of fusing the aggregated particles by heating. Each step will be described in detail below.

The process of the invention for producing an electrostatic-image-developing toner involves including a dispersing step of dispersing the resin particles and the releasing agent particles in an aqueous medium, and an aggregating step of aggregating the dispersed resin particles and releasing agent particles to obtain aggregated particles.

In the dispersing step, the binder resin and the releasing agent are used preferably in the form of a dispersion thereof.

As the method of dispersing the binder resin and the releasing agent in an aqueous medium to form particles, a proper method can also be selected from among known methods such as forced emulsification method, self-emulsification method, and phase-inversion emulsification method. Among these, a self-emulsification method and a phase inversion emulsification method are preferred in view of the energy required for emulsification, the controllability of the particle diameter of emulsified product, and the safety.

The self-emulsification method and phase inversion emulsification method are described in *Chobiryushi Polymer no Oyo Gijutsu* (Applied Technology of Ultrafine Particulate Polymer), CMC. As for the polar group used in the self-emulsification method, a carboxyl group, a sulfone group, or the like may be used.

Also, as will be described hereinafter, it is preferred to use a dispersion of a binder resin obtained by emulsion polymerization according to the miniemulsion process as the binder resin particle dispersion.

Also, in the production of the toner according to the invention, a surfactant may be used for the purpose of, for example, stabilizing the system upon dispersion in the suspension polymerization process, or stabilizing a resin particle dispersion, a colorant particle dispersion, and a releasing agent dispersion in the emulsion polymerization aggregation process.

Examples of the surfactant include anionic surfactants such as sulfate ester salt type, sulfonate type, phosphate type, and soap type; cationic surfactants such as amine salt type and quaternary ammonium salt type; nonionic type surfactants such as polyethylene glycol type, alkyl phenol ethylene oxide adduct type, and polyhydric alcohol type. Among these examples, ionic surfactants are preferred, with anionic surfactants and cationic surfactants being more preferred.

In the invention, an anionic surfactant generally has a strong dispersing force and is excellent in dispersing the resin particles and the colorant upon production of the toner. Also, as a surfactant for dispersing the releasing agent, an anionic surfactant is advantageously used.

Nonionic surfactants are preferably used in combination with the above-mentioned anionic surfactant or the cationic surfactant. The above-mentioned surfactant may be alone or in combination of two or more thereof.

Specific examples of the anionic surfactant include fatty acid soaps such as potassium laurate, sodium oleate, and sodium castor oil; sulfate esters such as octyl sulfate, lauryl sulfate, lauryl ether sulfate, and nonyl phenyl ether sulfate; sulfonates such as lauryl sulfonate, dodecylbenzene sulfonate, sodium alkylnaphthalene sulfonate (e.g., triisopropylnaphthalene sulfonate, or dibutylnaphthalene sulfonate), naphthalene sulfonate formalin condensate, monooctyl sulfosuccinate, dioctyl sulfosuccinate, lauric acid amide sulfonate, and oleic acid amide sulfonate; phosphate esters such as lauryl phosphate, isopropyl phosphate, nonyl phenyl ether phosphate; and sulfosuccinates such as dialkyl sulfosuccinate (e.g., sodium dioctyl sulfosuccinate), and disodium lauryl sulfosuccinate.

Specific examples of the cationic surfactant include amine salts such as laurylamine hydrochloride, stearylamine hydrochloride, oleylamine acetate, stearylamine acetate, and stearylaminopropylamine acetate; and quaternary ammonium salts such as lauryltrimethylammonium chloride, dilauryldimethylammonium chloride, distearyldimethylammonium chloride, distearyldimethylammonium chloride, lauryldihydroxyethylmethylammonium chloride, oleylbispolyoxyethylenemethylammonium chloride, lauroylaminopropyldimethylethylammonium ethosulfate, lauroylaminopropyldimethylhydroxyethylammonium perchlorate, alkylbenzenetrimethylammonium chloride, alkyltrimethylammonium chloride, and tetradecyltrimethylammonium bromide (TTAB).

Specific examples of the nonionic surfactant include alkyl ethers such as polyoxyethylene octyl ether, polyoxyethylene lauryl ether, polyoxyethylene stearyl ether, and polyoxyethylene oleyl ether; alkyl phenyl ethers such as polyoxyethylene octyl phenyl ether, and polyoxyethylene nonyl phenyl ether; alkyl esters such as polyoxyethylene laurate, polyoxyethylene stearate, and polyoxyethylene oleate; alkylamines such as polyoxyethylene lauryl aminoether, polyoxyethylene stearyl aminoether, polyoxyethyelne oleyl aminoether, polyoxyethylene soybean aminoether, and polyoxyethylene beef tallow aminoether; alkylamides such as polyoxyethylene lauric acid amide, polyoxyethylene stearic acid amide, and polyoxyethylene oleic acid amide; vegetable oil ethers such as polyoxyethylene castor oil ether and polyoxyethylene rapeseed oil ether; alkanolamides such as lauric acid diethanol amide, stearic acid diethanol amide, and oleic acid diethanol amide; and sorbitan ester ethers such as polyoxyethylene sorbitan monolaurate, polyoxyethylene sorbitan monopalmitate, polyoxyethylene sorbitan monostearate, and polyoxyethylene sorbitan monooleate.

The content of the surfactant in each dispersion may be at a level which the surfactant does not inhibit the invention, and is generally at a small level, specifically in the range of from 0.01 to 3% by weight, more preferably from 0.05 to 2% by weight, still more preferably from 0.1 to 2% by weight. When the content is within the above-mentioned range, each of the resin particle dispersion, the colorant particle dispersion, and the releasing agent particle dispersion is stable and does not suffer aggregation and isolation of particular particles, and the advantage of the invention can be fully obtained, thus such content being preferred. Generally, a suspension polymerization toner dispersion having a large particle diameter is stable even when the content of the used surfactant is small.

As the dispersion stabilizer which can be used in, for example, the aforesaid suspension polymerization process, a scarcely water-soluble, hydrophilic inorganic fine powder can be used. Examples of the inorganic fine powder include silica, alumina, titania, calcium carbonate, magnesium carbonate, tricalcium phosphate (hydroxyapatite), clay, diatomaceous earth, and bentonite. Of these, calcium carbonate and tricalcium phosphate are preferred in view of easiness for forming fine particles and easiness of their removal.

Also, an aqueous polymer which is solid at ordinary temperature may be used as the dispersion stabilizer. Specific examples thereof include cellulose series compounds such as carboxymethyl cellulose and hydroxypropyl cellulose, polyvinyl alcohol, gelatin, starch, and arabic gum.

In the case of using an organic solvent in preparing the resin particle dispersion or the like, it is preferred to entirely or partially remove the organic solvent.

For example, it is preferred that, after the binder resin-containing material or the like has been emulsified, the organic solvent is partially removed, thereby performing solidification as particles. Specific examples of solidification include a method of emulsion-dispersing the polycondensation resin-containing material or the like in an aqueous medium, and then removing the organic solvent by drying in a gas-liquid interface with stirring while introducing air or inert gas such as nitrogen (a waste air drying method), a method of performing drying under reduced pressure while bubbling a solution with inert gas as needed (a topping method under reduced pressure), and a method of discharging an emulsified dispersion in which the polycondensation resin-containing material is emulsion-dispersed in an aqueous medium or an emulsion of the polycondensation resin-containing material through fine nozzles like a shower, dropping it on a dish-shaped receiver, and repeating this operation to dry it (a shower type desolvation method). It is preferred that these methods are appropriately selected or combined, depending upon the rate of evaporation of the organic solvent used, the solubility in water and the like to perform desolvation.

The aggregation method to be employed in the aforesaid aggregating step is not particularly limited, and aggregating methods conventionally employed for the emulsion polymerization aggregation process for producing a toner, such as methods of reducing stability of the emulsion by, for example, increasing the temperature, changing the pH, or by addition of a salt, followed by stirring in a disperser, are employed.

Also, in the aggregating step, individual particles in the resin particle dispersion, the colorant dispersion, and the releasing agent dispersion having been mutually mixed can be aggregated to form aggregated particles having a toner particle diameter. The aggregated particles are formed by, for example, hetero aggregation. Also, for the purpose of stabilizing the aggregated particles and controlling particle size/particle size distribution, an ionic surfactant having a polarity different from that of the aggregated particles or a compound having at least a monovalent charge such as a metal salt may be added.

Also, in the aggregating step, the toner particle diameter and the particle diameter distribution can be adjusted in a known aggregating method by, for example, forming resin polymer particles from oil droplets which are emulsion-dispersed in an aqueous phase through polymerization of a monomer contained in the oil droplets in the presence of a polymerization initiator, and then aggregating (associating) the thus-formed polymer particles with the releasing agent particles by the known aggregation process.

Preferably, toner particles are produced by the emulsion polymerization aggregation process. Specifically, the thus-obtained resin particle dispersion is mixed with the colorant particle dispersion and the releasing agent particle dispersion, adding thereto an aggregating agent to cause hetero aggregation and form aggregated particles having a toner particle diameter, and then heating to a temperature equal to or higher than the glass transition temperature of the resin particles or to a temperature equal to or higher than the melting temperature to fuse and coalesce the aggregated particles, followed by washing and drying to thereby obtain the toner particles. This process enables one to control the toner shape from an amorphous shape to a spherical shape by selecting the heating temperature condition.

In the aggregating step, it is possible to mix two or more kinds of resin particle dispersions, with the steps after the aggregating step being performed in the same manner. In this occasion, it is possible to form multi-layer particles by previously aggregating a resin particle dispersion to form first aggregated particles, and then adding thereto another kind of resin particle dispersion to thereby form a second shell layer on the surface of the first aggregated particles. Needless to say, it is also possible to prepare multi-layer particles in the order reverse to that in the above-described example.

Further, for the purpose of suppressing bleeding of the colorant from the surface of the particles, the surface of the particles maybe crosslinked by, for example, thermal treatment. Incidentally, the used surfactants and the like may be removed, as needed, by washing with waters washing with an acid, or washing with an alkali.

In the case of employing in the invention the emulsion aggregation coalescence process for producing the toner, particles can be prepared by causing aggregation by changing pH in the aggregating step. At the same time, an aggregating agent may be added thereto to stabilize and promote aggregation of particles or to obtain aggregated particles having a narrower particle size distribution.

As the aggregating agent, compounds having at least a monovalent charge are preferred, and specific examples thereof include water-soluble surfactants such as the aforesaid ionic surfactants and nonionic surfactants; acids such as hydrochloric acid, sulfuric acid, nitric acid, acetic acid, and oxalic acid; metal salts of inorganic acids, such as magnesium chloride, sodium chloride, aluminum chloride (including polyaluminum chloride), aluminum sulfate, calcium sulfate, ammonium sulfate, aluminum nitrate, silver nitrate, copper sulfate, and sodium carbonate; metal salts of aliphatic acids or aromatic acids, such as sodium acetate, potassium formate, sodium oxalate, sodium phthalate, and potassium salicylate; metal salts of phenols, such as sodium phenolate; metal salts of amino acids; and inorganic acid salts of aliphatic or aromatic amines, such as triethanolamine hydrochloride and aniline hydrochloride.

In consideration of stability of aggregated particles, stability of the aggregating agent against heat or with lapse of time, and removal upon washing, metal salts of inorganic acids are preferred a the aggregating agents in view of performance and easy-to-use convenience. Specific examples thereof include metal salts of inorganic acids, such as magnesium chloride, sodium chloride, aluminum chloride (including polyaluminum chloride), aluminum sulfate, ammonium sulfate, aluminumnitrate, silvernitrate, coppersulfate, and sodium carbonate.

The addition amount of the aggregating agent varies depending upon the number of valence of charge. However, the addition amount is set to a small level of about 3% by weight or less based on the total weight of the toner with a monovalent aggregating agent, about 1% by weight or less with a divalent aggregating agent, and about 0.5% by weight or less with a trivalent aggregating agent. A smaller addition amount of the aggregating agent is more preferred, and hence compounds having a higher number of valence are more preferably used.

The process of the invention for producing an electrostatic-image-developing toner includes the fusing step of busing the aggregated particles by heating.

In the fusing step, the binder resin or the releasing agent in the aggregated particles is molten at a temperature equal to or higher than the melting temperature or the glass transition temperature, with the form of the aggregated particles being changed from an amorphous shape to a more spherical shape.

In order to maintain the phase separation structure in the toner based on the resin particles having the core-shell structure wherein a higher Tg phase constitutes the shell, it is preferred to melt under the condition of heating to a temperature within +50° C. of the glass transition temperature of the resin constituting the shell. When melting under the condition of heating to a temperature within +50° C. of the glass transition temperature of the resin constituting the shell, reduction of viscosity of the core component scarcely occurs, and hence coalescence of the resin for the core scarcely advances, thus the microscopic phase separation structure being maintained, and plastic behavior for pressure being sufficient. Hence, such heating condition is preferred.

Thereafter, the aggregated product is separated out of the aqueous medium and, as needed, washed with water and dried to thereby form toner particles.

After completion of the aggregating step and the fusing step, the toner particles may optionally be subjected to an arbitrary washing step, solid-liquid separating step, and drying step to obtain desired toner particles. With the washing step, it is preferred to conduct sufficient substitution washing using deionized water in view of charging properties. Also, the solid-liquid separating step is not particularly limited but, in view of productivity, suction filtration or pressure filtration is preferably used. Further, the drying step is not particularly limited, either but, in view of productivity, freeze-drying, flush-jet drying, fluidized drying, or fluidized drying under shake is preferably used.

III. Electrostatic Image Developer

The electrostatic-image-developing toner having so far been described can be used as an electrostatic image developer (developer) This developer is not particularly limited except for containing this toner, and a proper component formulation can be employed depending upon the purpose. When the toner is independently used, there is prepared a one-component developer and, when used in combination with a carrier, there is prepared a two-component developer.

The carrier which can be used in the invention is not particularly limited, and examples thereof usually include magnetic particles such as iron powder, ferrite, iron oxide powder, and nickel; resin-coated carriers including a core material of magnetic particles having coated thereon a resin such as a styrene series resin, vinyl series resin, ethylene series resin, rosin series resin, polyester series resin, or a melamine series resin, or a wax such as stearic acid to form a resin coating layer; and magnetic material dispersion type carriers wherein magnetic particles are dispersed in a binder resin. Of them, resin-coated carriers are particularly preferred since charging properties of the toner and resistance of the entire carrier can be controlled by selecting the constitution of the resin coating layer.

The mixing ratio of the toner and the carrier in the two-component electrostatic image developer is preferably such that 2 to 10 parts by weight of the toner is used per 100 parts by weight of the carrier. Also, the process for preparing the developer is not particularly limited but, for example, there is illustrated a process of mixing in a V blender.

IV. Image-Forming Method and Image-Forming Apparatus

The image-forming method of the invention includes an electrostatic latent image-forming step of forming an electrostatic latent image on a surface of a latent image holding member, a developing step of developing the electrostatic latent image on the latent image holding member with a developer containing a toner to form a toner image, a transfer step of transferring the toner image onto a surface of a recording material to form a transferred toner image, and a fixing step of fixing the transferred toner image by applying pressure, with the toner being the electrostatic-image-developing toner of the invention, the electrostatic-image-developing toner produced by the production process of the invention, or the developer being the electrostatic image developer of the invention.

In the image-forming method of the invention, the fixing temperature in the fixing step is preferably from 15° C. to 50° C., and the fixing pressure in the fixing step is preferably from 0.1 MPa to 5 MPa.

Also, the image-forming apparatus of the invention includes a latent image holding member, a charging unit that charges the latent image holding member, an exposing unit that exposes the charged latent image holding member to form an electrostatic latent image on the latent image holding member, a developing unit that develops the electrostatic latent image with a developer containing a toner to form a toner image, a transferring unit that transfers the toner image from the latent image holding member to a recording material, and a fixing unit that fixes the transferred image by applying pressure, with the toner being the electrostatic-image-developing toner of the invention, the electrostatic-image-developing toner produced by the production process of the invention, or the developer being the electrostatic image developer of the invention.

The image-forming method and the image-forming apparatus of the invention will be described below.

Each of the above-described steps can be performed by known methods and known units having been employed in the conventional image-forming methods and image-forming apparatuses. Also, in the invention, the recording material is a final recording material and, in the case of using an intermediate transfer member, the toner image formed on the electrostatic image holding member is once transferred onto the intermediate transfer member, and the thus-transferred image is finally transferred to the recording material, followed by fixing the toner image transferred onto the surface of the recording material on the surface of the recording material.

Further, the image-forming method may include other steps than the above-described steps, for example, a cleaning step of cleaning the surface of the latent image holding member, and the image-forming apparatus may include, for example, a cleaning unit for cleaning the surface of the latent image holding member.

In the case of using an electrophotographic photoreceptor as the latent image holding member, the image-forming method may be conducted, for example, in the following manner. First, the surface of the electrophotographic photoreceptor is uniformly charged by means of a corotron charger or a contact charger, and imagewise exposed to form an electrostatic latent image. Subsequently, the photoreceptor is brought into contact with or brought into the vicinity of a developing roll having formed on the surface thereof a developer layer to thereby deposit toner particles onto the electrostatic latent image to thereby form a toner image on the electrophotographic photoreceptor. The thus-formed toner image is transferred to the surface of a recording material such as paper utilizing a corotron charger or the like. Further, the toner image transferred onto the surface of the recording medium is fixed by means of a fixing device to form an image on the recording medium.

Additionally, as the electrophotoraphic photoreceptor, inorganic photoreceptors such as an amorphous silicon photoreceptor and a selenium photoreceptor and organic photoreceptors using polysilane or phthalocyanine as a charge generating material or a charge transporting material can generally be used, with an amorphous silicon photoreceptor being preferred owing to its long life.

Fixing Step and Fixing Means

In the invention, the fixing step is conducted by applying pressure preferably without heating.

The fixing pressure is preferably from about 0.1 MPa to about 5 MPa, more preferably from about 0.15 MPa to about 3 MPa, still more preferably from about 0.2 MPa to about 2 MPa. In case the when the pressure upon fixing (fixing pressure) is 0.1 MPa or more, there results sufficient fixing properties, thus such pressure being preferred. Also, when the pressure is 5 MPa or less, problems such as curling of paper after fixing (called "paper curling") scarcely arise, thus such pressure being preferred.

The term "fixing pressure" as used herein means the following maximum fixing pressure.

As a fixing roll, a proper one may be selected to use from among conventionally known fixing rolls so long as it can permit application of the fixing pressure.

For example, there can be illustrated fixing rolls prepared by coating a fluorine-containing resin (for example, TEFLON (trade name)), a silicone series resin or a perfluoroalkylate on a cylindrical core metal. In order to obtain a high fixing pressure, a fixing roll made of SUS may also be used. The fixing step is generally conducted by passing a recording material between two rolls. The two rolls may be formed by the same material or by different materials. For example, there are illustrated a combination of SUS/SUS, a combination of SUS/silicone resin, a combination of SUS/PSA, and a combination of PFA/PFA.

The pressure distribution between the fixing roll and the pressure roll can be measured by a commercially available pressure distribution-measuring sensor, specifically by an interroll pressure measuring system manufactured by Kamata Industry Co., Ltd. In the invention, the maximum fixing pressure upon pressure fixing means the maximum value in pressure change in the course of from the inlet of the fixing nip to the outlet thereof in the paper advancing direction.

In the invention, the fixing step is preferably performed without heating. Here, to perform fixing without heating means to have no heating unit for directly heating the fixing unit. Therefore, a rise in temperature within the machine to a level higher than the environmental temperature due to heat generated by other power sources is not excluded. The fixing temperature is preferably from about 15° C. to about 50° C., more preferably from about 15° C. to about 45° C., still more preferably from about 15° C. to about 40° C.

When the fixing temperature is within the above-described range, there can be obtained excellent fixing properties, thus such temperature being preferred.

EXAMPLES

The invention will be described more specifically by reference to Examples and Comparative Examples. However, the invention is in no way limited by the content of the Examples presented below. In the following description, unless stated otherwise, the units "parts" are all "parts by weight", and the units "%" are all "% by weight".

Measurement of Molecular Weight

The molecular weight is measured in terms of the weight-average molecular weight Mw and the number-average molecular weight Mn according to gel permeation chromatography (GPC) under the following conditions. That is, at a temperature of 40° C., the measurement is conducted by allowing to flow a solvent (tetrahydrofuran) at a flow rate of 1.2 ml per minute, and injecting 3 mg of a sample solution in tetrahydrofuran into the column. In measuring the molecular weight of the sample, the measuring conditions are selected such that the molecular weight of the sample falls within the range where the logarithms of the molecular weights of calibration curves made by several kinds of monodisperse polystyrene standard samples and the count numbers make a straight line. Incidentally, reliability of the results of the measurement can be confirmed by the fact that NBS706 polystyrene standard sample on the above-described measuring conditions shows the following values.

Weight-average molecular weight $Mw=28.8\times10^4$

Number-average molecular weight $Mn=13.7\times10^4$

Incidentally, as the columns of GPC, TSK-GEL, GMH (manufactured by TOSO CORPORATION) which satisfies the above-described conditions is used.

Measurement of Median Diameter

With particles of less than 1 μm in diameter, the median diameter is measured by means of a laser diffraction particle size distribution analyzer (LA-920; manufactured by Horiba, Ltd.) and, with particles of 1 μm or more in diameter, the median diameter is measured by means of the Coulter Multisizer-II (manufactured by Beckman Coulter, Inc.).

Measurement of Glass Transition Temperature and Melting Temperature

The glass transition temperature and the melting temperature are measured by means of a differential scanning calorimeter (DSC-50; manufactured by Shimadzu Seisakusho Co., Ltd.).

Fixing Test and Image-Maintaining Test

Evaluation of Toner

A modified machine of DocuCentreColor f450 (manufactured by Fuji Xerox Co., Ltd. is used for evaluating toners. As a fixing machine, two-roll type fixing device which permits adjustment of the maximum fixing pressure is modified to use, with the image side pressure roll being changed to a roll having a high hardness including an SUS tube coated with TEFLON (trade name). As a recording material, the above-described S paper (manufactured by Fuji Xerox Co., Ltd. is used.

Preparation of Resin Particle Dispersion (A1) (Styrene-Butyl Acrylate Series, Acidic Polar Group-Containing Series)

300 parts of deionized water and 1.5 parts of TTAB (tetradecyltrimethylammonium bromide; manufactured by Sigma Chemical Co., Ltd.) are placed in a round flask, and a nitrogen gas is bubbled thereinto for 20 minutes, followed by increasing the temperature up to 65° C. under stirring. Then, 40 parts of n-butyl acrylate monomer is added thereto, and stirring is further conducted for 20 minutes. 0.5 part of an initiator V-50 (2,2'-azobis(2-methylpropionamidine)dihydrochloride; manufactured by Wako Pure Chemical Industries, Ltd.) previously dissolved in 10 parts of deionized water is added to the flask. The resulting mixture is kept at 65° C. for 3 hours, and then an emulsion prepared by emulsifying 50 parts of styrene monomer, 20 parts of n-butyl acrylate monomer, 2.5 parts of acrylic acid, and 0.8 part of dodecanethiol in 100 parts of deionized water containing dissolved therein 0.5 part of TTAB is continuously introduced into the flask over 2 hours using a metering pump. The temperature is increased to 70° C., and is kept for 2 hours to complete polymerization. Thus, there is obtained a core-shell type resin particle dispersion (A1) having a weight-average molecular weight Mw of 22,000, an average particle size of 170 nm, and a content of solids of 25% by weight.

Additionally, that the resulting resin particles are core-shell type resin particles is confirmed by embedding the particles in an epoxy resin, preparing a cross-sectioned thin slice from the particles-containing resin with a diamond knife, dyeing it with ruthenium vapor, and observing it with a transmission type electron microscope.

After drying the resin at 40° C., Tg behavior is observed by using a differential scanning calorimeter (DSC, manufactured by Shimadzu Seisakusho Co., Ltd.) starting from −150°

C., thus the glass transition temperature based on polybutyl acrylate being found at about −48° C. and the glass transition temperature presumably based on styrene-butyl acrylate-acrylic acid copolymer being found at about 56° C. (Difference in the glass transition temperature: 104° C.)

Preparation of Resin Particle Dispersion (A2) (Styrene-2-Ethylhexyl Acrylate (EHA) Series, Basic Polar Group-Containing Series)

300 parts of deionized water and 1.5 parts of TTAB (tetradecyltrimethylammonium bromide; manufactured by Sigma Chemical Co., Ltd.) are placed in a round flask, and a nitrogen gas is bubbled thereinto for 20 minutes, followed by increasing the temperature up to 65° C. under stirring. Then, 40 parts of 2-ethylhexyl acrylate monomer is added thereto, and stirring is further conducted for 20 minutes. 0.5 part of an initiator V-50 (2,2'-azobis(2-methylpropionamidine)dihydrochloride; manufactured by Wako Pure Chemical Industries, Ltd.) previously dissolved in 10 parts of deionized water is added to the flask. The resulting mixture is kept at 65° C. for 3 hours, and then an emulsion prepared by emulsifying 50 parts of styrene monomer, 20 parts of 2-ethylhexyl acrylate monomer, 1.2 parts of diethylaminoethyl acrylate, and 0.8 part of dodecanethiol in 100 parts of deionized water containing dissolved therein 0.5 part of TTAB is continuously introduced into the flask over 2 hours using a metering pump. The temperature is increased to 70° C., and is kept for 2 hours to complete polymerization. Thus, there is obtained a core-shell type resin particle dispersion (A2) having a weight-average molecular weight Mw of 25,000, an average particle size of 130 nm, and a content of solids of 25% by weight.

Additionally, that the resulting resin particles are core-shell type resin particles is confirmed by embedding the particles in an epoxy resin, preparing a cross-sectioned thin slice from the particles-containing resin with a diamond knife, dyeing it with ruthenium vapor, and observing it with a transmission type electron microscope.

After air-drying the resin at 40° C., Tg behavior is observed by using a differential scanning calorimeter (DSC; manufactured by Shimadzu Seisakusho Co., Ltd.) starting from −150° C., thus the glass transition temperature based on poly(2-ethylhexyl acrylate) being found at about −60° C. and the glass transition temperature presumably based on styrene-butyl acrylate-diethylaminoethyl acrylate copolymer being found at about 55° C. (Difference in the glass transition temperature: 115° C.)

Preparation of Resin Particle Dispersion (A3) (Styrene-Butyl Methacrylate (nBMA) Series, Alcoholic Hydroxyl Group Series)

300 parts of deionized water and 1.5 parts of TTAB (tetradecyltrimethylammonium bromide; manufactured by Sigma Chemical Co., Ltd.) are placed in a round flask, and a nitrogen gas is bubbled thereinto for 20 minutes, followed by increasing the temperature up to 65° C. under stirring. Then, 40 parts of n-butyl methacrylate monomer is added thereto, and stirring is further conducted for 20 minutes. 0.5 part of an initiator V-50 (2,2'-azobis(2-methylpropionamidine)dihydrochloride; manufactured by Wako Pure Chemical Industries, Ltd.) previously dissolved in 10 parts of deionized water is added to the flask. The resulting mixture is kept at 65° C. for 3 hours, and then an emulsion prepared by emulsifying 50 parts of styrene monomer, 20 parts of n-butyl acrylate monomer, 2 parts of 2-hydroxyethyl methacrylate, and 0.8 part of dodecanethiol in 100 parts of deionized water containing dissolved therein 0.5 part of TTAB is continuously introduced into the flask over 2 hours using a metering pump. The temperature is increased to 70° C., and is kept for 2 hours to complete polymerization. Thus, there is obtained a core-shell type resin particle dispersion (A3) having a weight-average molecular weight Mw of 21,000, an average particle size of 260 nm, and a content of solids of 25% by weight.

Additionally, that the resulting resin particles are core-shell type resin particles is confirmed by embedding the particles in an epoxy resin, preparing a cross-sectioned thin slice from the particles-containing resin with a diamond knife, dyeing it with ruthenium vapor, and observing it with a transmission type electron microscope.

After air-drying the resin at 40° C., Tg behavior is observed by using a differential scanning calorimeter (DSC; manufactured by Shimadzu Seisakusho Co., Ltd.) starting from −150° C., thus the glass transition temperature based on polybutyl methacrylate being found at about 25° C. and the glass transition temperature presumably based on styrene-butyl acrylate-2-hydroxyethyl methacrylate copolymer being found at about 48° C. (Difference in the glass transition temperature: 23° C.)

Preparation of Resin Particle Dispersion (A4) (Styrene-Butyl Methacrylate (nBMA) Series, Alcoholic Hydroxyl Group Series)

300 parts of deionized water and 1.5 parts of TTAB (tetradecyltrimethylammonium bromide; manufactured by Sigma Chemical Co., Ltd.) are placed in a round flask, and a nitrogen gas is bubbled thereinto for 20 minutes, followed by increasing the temperature up to 65° C. under stirring. Then, 40 parts of n-butyl methacrylate monomer is added thereto, and stirring is further conducted for 20 minutes. 0.5 part of an initiator V-50 (2,2'-azobis(2-methylpropionamidine)dihydrochloride; manufactured by Wako Pure Chemical Industries, Ltd.) previously dissolved in 10 parts of deionized water is added to the flask. The resulting mixture is kept at 65° C. for 3 hours, and then an emulsion prepared by emulsifying 50 parts of styrene monomer, 30 parts of n-butyl acrylate monomer, 2 parts of 2-hydroxyethyl methacrylate, and 0.8 part of dodecanethiol in 100 parts of deionized water containing dissolved therein 0.5 part of TTAB is continuously introduced into the flask over 2 hours using a metering pump. The temperature is increased to 70° C., and is kept for 2 hours to complete polymerization. Thus, there is obtained a core-shell type resin particle dispersion (A4) having a weight-average molecular weight Mw of 25,000, an average particle size of 280 nm, and a content of solids of 25% by weight.

Additionally, that the resulting resin particles are core-shell type resin particles is confirmed by embedding the particles in an epoxy resin, preparing a cross-sectioned thin slice from the particles-containing resin with a diamond knife, dyeing it with ruthenium vapor, and observing it with a transmission type electron microscope.

After air-drying the resin at 40° C., Tg behavior is observed by using a differential scanning calorimeter (DSC; manufactured by Shimadzu Seisakusho Co., Ltd.) starting from −150° C., thus the glass transition temperature based on polybutyl methacrylate being found at about 25° C. and the glass transition temperature presumably based on styrene-butyl acrylate-2-hydroxyethyl methacrylate copolymer being found at about 40° C. (Difference in the glass transition temperature: 15° C.)

Data on the resin particle emulsions (A1) to (A4) are described in the following table.

TABLE 1

| | Resin Particle Dispersion | | | |
|---|---|---|---|---|
| | A1 | A2 | A3 | A4 |
| Tg of core (° C.) | −48 | −60 | 25 | 25 |
| Tg of shell (° C.) | 56 | 55 | 48 | 40 |
| Tg Difference (Tg of shell − Tg of core) (° C.) | 104 | 115 | 23 | 15 |
| Median diameter of core-shell particles (nm) | 170 | 130 | 260 | 280 |
| Weight-average molecular weight | 22,000 | 25,000 | 21,000 | 25,000 |

Preparation of Releasing Agent Particle Dispersion

| <Preparation of releasing agent particle dispersion (B1)> | |
|---|---|
| 1,4-Cyclohexanedicarboxylic acid | 175 parts |
| Ethylene oxide (2 mols) adduct of Bisphenol A | 310 parts |
| Dodecylbenzenesulfonic acid | 0.5 part |

The above-described materials are mixed, and introduced into a reactor equipped with a stirrer, followed by conducting polycondensation at 100° C. for 1 hour under a nitrogen atmosphere to thereby obtain a uniform, transparent, non-crystalline polyester resin.

The resin is found to have a weight-average molecular weight of 1,000 by GPC.

| | |
|---|---|
| Caprolactone | 90 parts |
| Dodecylbenzenesulfonic acid | 0.2 part |

The above-described materials are mixed, and introduced into a reactor equipped with a stirrer, followed by conducting polymerization reaction at 90° C. for 1 hour under a nitrogen atmosphere to thereby obtain a uniform, transparent, crystalline polyester resin.

The resin is found to have a weight-average molecular weight of 1,200 by GPC and a crystal melting temperature of 60° C.

Further, two kinds of the above-described polyester resins are mixed at 100° C., and heated for 2 hours in a reactor equipped with a stirrer to thereby form a polyester block copolymer. The copolymer is found to have, as a polyester block copolymer, a glass transition temperature (onset) of 50° C. by DSC and a melting temperature at about 60° C. as a small peak.

Also, the weight-average molecular weight is found to be 2,400 by GPC.

To 100 parts of this resin is added 0.5 part of soft-type sodium dodecylbenzenesulfonate as a surfactant and, further, 300 parts of deionized water is added thereto, followed by sufficiently mixing and dispersing by means of a homogenizer (ULTRATALUX T50; manufactured by IKA Co., Ltd.) in a round flask while heating to 80° C.

Subsequently, the pH within the system is adjusted to 5.0 with a 0.5 mol/liter sodium hydroxide aqueous solution, followed by heating up to 90° C. with keeping the stirring by means of the homogenizer to thereby obtain a dispersion of the particles of the polyester block copolymer (releasing agent). Thus, there is obtained a releasing agent particle dispersion (B1) of 210 nm in center diameter of the releasing agent particles and 20% in the content of solid components.

| <Preparation of releasing agent particle dispersion (B2)> | |
|---|---|
| 1,4-Cyclohexanedicarboxylic acid | 175 parts |
| Ethylene oxide (2 mols) adduct of Bisphenol A | 310 parts |
| Dodecylbenzenesulfonic acid | 0.5 part |

The above-described materials are mixed, and introduced into a reactor equipped with a stirrer, followed by conducting polycondensation at 100° C. for 1 hour under a nitrogen atmosphere to thereby obtain a uniform, transparent, non-crystalline polyester resin.

The resin is found to have a weight-average molecular weight of 1,100 by GPC.

| | |
|---|---|
| Dodecylbenzenesulfonic acid | 0.36 part |
| 1,9-Nonanediol | 80 parts |
| 1,10-Decamethylenedicarboxylic acid | 115 parts |

The above-described materials are mixed and heated at 80° C. to melt, followed by keeping at 80° C. for 30 minutes to thereby obtain a crystalline polyester resin of 1,000 in weight-average molecular weight measured by GPC and 62° C. in crystal melting temperature.

Further, two kinds of the above-described polyester resins are mixed at 100° C., and heated for 30 minutes in a reactor equipped with a stirrer to thereby form a polyester block copolymer. The copolymer is found to have, as a polyester block copolymer, a glass transition temperature (onset) of 52° C. by DSC and a melting temperature at about 60° C. The weight-average molecular weight is found to be 1,900 by GPC.

To 100 parts of this resin is added 0.5 part of soft-type sodium dodecylbenzenesulfonate as a surfactant and, further, 300 parts of deionized water is added thereto, followed by heating to 80° C. and, at the same time, sufficiently mixing and dispersing by means of a homogenizer (ULTRATALUX T50; manufactured by IKA Co., Ltd.) in a round flask while heating to 80° C.

Subsequently, the pH within the system is adjusted to 5.0 with a 0.5 mol/liter sodium hydroxide aqueous solution, followed by heating up to 90° C. with keeping the stirring by means of the homogenizer to thereby obtain a dispersion of the particles of the polyester block copolymer (releasing agent). Thus, there is obtained a releasing agent particle dispersion (B2) of 180 nm in center diameter of the releasing agent particles and 20% in the content of solid components.

| <Preparation of releasing agent particle dispersion (B3)> | |
|---|---|
| 1,4-phenylenedipropanoic acid | 222 parts |
| Propylene oxide (2 mols) adduct of Bisphenol A | 344 parts |
| p-Toluenesulfonic acid | 0.7 part |

The above-described materials are mixed, and introduced into a reactor equipped with a stirrer, followed by conducting polycondensation at 80° C. for 1 hour under a nitrogen atmosphere to thereby obtain a uniform, transparent, non-crystalline polyester resin. The resin is found to have a weight-average molecular weight of 900 by GPC.

| | |
|---|---|
| Dodecylbenzenesulfonic acid | 0.36 part |
| 1,9-Nonanediol | 80 parts |
| 1,10-Decamethylenedicarboxylic acid | 115 parts |

The above-described materials are mixed and heated at 120° C. to melt, followed by keeping at 80° C. for 30 minutes to thereby obtain a crystalline polyester resin of 1,500 in weight-average molecular weight measured by GPC and 62° C. in crystal melting temperature.

Further, two kinds of the above-described polyester resins are mixed at 100° C., and heated for 30 minutes in a reactor equipped with a stirrer to thereby form a polyester block copolymer. The copolymer is found to have, as a polyester block copolymer, a glass transition temperature (onset) of 50° C. by DSC and a melting temperature at about 60° C. The weight-average molecular weight is found to be 2,700 by GPC.

To 100 parts of this resin is added 0.5 part of soft-type sodium dodecylbenzenesulfonate as a surfactant and, further, 300 parts of deionized water is added thereto, followed by heating to 80° C. and, at the same time, sufficiently mixing and dispersing by means of a homogenizer (ULTRATALUX T50; manufactured by IKA Co., Ltd.) in a round flask while heating to 80° C.

Subsequently, the pH within the system is adjusted to 5.0 with a 0.5 mol/liter sodium hydroxide aqueous solution, followed by heating up to 90° C. with keeping the stirring by means of the homogenizer to thereby obtain a dispersion of the particles of the polyester block copolymer (releasing agent). Thus, there is obtained a releasing agent particle dispersion (B3) of 200 nm in center diameter of the releasing agent particles and 20% in the content of solid components.

Preparation of Releasing Agent Particle Dispersion (B4)

Further, in the same manner as with the releasing agent particle dispersion (B3) except for changing the mixing and heating time employed upon mixing the non-crystalline polyester resin with the crystalline polyester resin to 1 hour, there is obtained a polyester block copolymer of 3,500 in weight-average molecular weight. The copolymer is found to have, as a polyester block copolymer, a glass transition temperature (onset) of 50° C. by DSC and a melting temperature at about 60° C. The copolymer is formed into a dispersion in the same manner as with the releasing agent particle dispersion (B3) to obtain a releasing agent particle dispersion (B4).

| <Preparation of releasing agent particle dispersion (B5)> | |
|---|---|
| 1,4-Cyclohexanedicarboxylic acid | 175 parts |
| Ethylene oxide (2 mols) adduct of Bisphenol A | 310 parts |
| Dodecylbenzenesulfonic acid | 0.1 part |

The above-described materials are mixed, and introduced into a reactor equipped with a stirrer, followed by conducting polycondensation at 100° C. for 30 minutes under a nitrogen atmosphere to thereby obtain a uniform, transparent, non-crystalline polyester resin.

The resin is found to have a weight-average molecular weight of 600 by GPC.

| | |
|---|---|
| Caprolactone | 90 parts |
| Dodecylbenzenesulfonic acid | 0.1 part |

The above-described materials are mixed, and introduced into a reactor equipped with a stirrer, followed by conducting polymerization reaction at 90° C. for 30 minutes under a nitrogen atmosphere to thereby obtain a uniform, transparent, crystalline polyester resin.

The resin is found to have a weight-average molecular weight of 500 by GPC and a crystal melting temperature of 60° C.

Further, two kinds of the above-described polyester resins are mixed at 100° C., and heated for 1 hour in a reactor equipped with a stirrer to thereby form a polyester block copolymer. The copolymer is found to have, as a polyester block copolymer, a glass transition temperature (onset) of 48° C. by DSC and a melting temperature at about 55° C. as a small peak.

Also, the weight-average molecular weight is found to be 1,200 by GPC.

To 100 parts of this resin is added 0.5 part of soft-type sodium dodecylbenzenesulfonate as a surfactant and, further, 300 parts of deionized water is added thereto, followed by sufficiently mixing and dispersing by means of a homogenizer (ULTRATALUX T50; manufactured by IKA Co., Ltd.) in a round flask while heating to 80° C.

Subsequently, the pH within the system is adjusted to 5.0 with a 0.5 mol/liter sodium hydroxide aqueous solution, followed by heating up to 90° C. with keeping the stirring by means of the homogenizer to thereby obtain a dispersion of the particles of the polyester block copolymer (releasing agent). Thus, there is obtained a releasing agent particle dispersion (B5) of 200 nm in center diameter of the releasing agent particles and 20% in the content of solid components.

| <Preparation of releasing agent particle dispersion (B6)> | |
|---|---|
| 1,4-Cyclohexanedicarboxylic acid | 175 parts |
| 1,4-Cyclohexanediol | 160 parts |
| Dodecylbenzenesulfonic acid | 0.3 part |

The above-described materials are mixed, and introduced into a reactor equipped with a stirrer, followed by conducting polycondensation at 100° C. for 1 hour under a nitrogen atmosphere to thereby obtain a uniform, transparent, non-crystalline polyester resin.

The resin is found to have a weight-average molecular weight of 950 by GPC.

| | |
|---|---|
| Caprolactone | 90 parts |
| Dodecylbenzenesulfonic acid | 0.1 part |

The above-described materials are mixed, and introduced into a reactor equipped with a stirrer, followed by conducting polymerization reaction at 90° C. for 1 hour under a nitrogen atmosphere to thereby obtain a uniform, transparent, crystalline polyester resin.

The resin is found to have a weight-average molecular weight of 900 by GPC and a crystal melting temperature of 60° C.

Further, two kinds of the above-described polyester resins are mixed at 100° C., and heated for 1 hour in a reactor equipped with a stirrer to thereby form a polyester block copolymer. The copolymer is found to have, as a polyester block copolymer, a glass transition temperature (onset) of 50° C. by DSC and a melting temperature at about 58° C. as a small peak.

Also, the weight-average molecular weight is found to be 1,800 by GPC.

To 100 parts of this resin is added 0.5 part of soft-type sodium dodecylbenzenesulfonate as a surfactant and, further, 300 parts of deionized water is added thereto, followed by sufficiently mixing and dispersing by means of a homogenizer (ULTRATALUX T50; manufactured by IKA Co., Ltd.) in a round flask while heating to 80° C.

Subsequently, the pH within the system is adjusted to 5.0 with a 0.5 mol/liter sodium hydroxide aqueous solution, followed by heating up to 90° C. with keeping the stirring by means of the homogenizer to thereby obtain a dispersion of the particles of the polyester block copolymer (releasing agent). Thus, there is obtained a releasing agent particle dispersion (B6) of 180 nm in center diameter of the releasing agent particles and 20% in the content of solid components.

Data on the releasing agent particle emulsions (B1) to (B6) are described in the following table.

TABLE 2

| | Releasing Agent Particle Dispersion | | | | | |
|---|---|---|---|---|---|---|
| | B1 | B2 | B3 | B4 | B5 | B6 |
| Weight-average molecular weight | 2,400 | 1,900 | 2,700 | 3,500 | 1,200 | 1,800 |
| Median diameter (nm) | 210 | 180 | 200 | 250 | 200 | 180 |

| <Preparation of colorant particle dispersion (1)> | |
|---|---|
| Cyan pigment (copper phthalocyanine C.I. pigment Blue 15:3; manufactured by Dainichiseika Color & Chemicals Mfg. Co., Ltd.) | 50 parts |
| Anionic surfactant (NEOGEN R; manufactured by Daiichi Kogyo Seiyaku Co., Ltd.) | 5 parts |
| Deionized water | 200 parts |

The above-described components are mixed and dispersed by subjecting the mixture to a homogenizer (ULTRATALUX; manufactured by IKA Co., Ltd.) for 5 minutes and to an ultrasonic bath for 10 minutes to thereby obtain a cyan colorant particle dispersion (1) of 190 nm in center diameter and 21.5% in the content of solid component.

Example 1

| (Preparation of toner particles 1) | |
|---|---|
| Resin particle dispersion (A1) | 168 parts (resin: 42 parts) |
| Colorant particle dispersion (1) | 40 parts (pigment: 8.6 parts) |
| Releasing agent particle dispersion (B1) | 40 parts (releasing agent: 8.6 parts) |
| Polyaluminum chloride | 0.15 part |
| Deionized water | 300 parts |

The components according to the above-described formulation are sufficiently mixed and dispersed by means of a homogenizer (ULTRATALUX T50; manufactured by IKA Co., Ltd.) in a round stainless steel-made flask, and then the content in the flask is heated up to 42° C. by rotating the flask in a heating oil bath and, after maintaining at 42° C. for 60 minutes, 105 parts (resin: 21 parts) of the resin particle dispersion (A1) is added thereto, followed by moderate stirring.

Subsequently, the pH of the mixture system is adjusted to 6.0 with a 0.5 mol/liter sodium hydroxide aqueous solution, and the mixture system is heated up to 95° C. while continuing stirring. In common cases, the pH of the mixture system is decreased to 5.0 or less during the period of heating up to 95° C. In this case, however, the pH is kept at 5.5 or more by additionally dropwise adding the sodium hydroxide aqueous solution.

After completion of the reaction, the reaction mixture is cooled, filtered, washed sufficiently with deionized water, and subjected to solid-liquid separation by Nutsche suction filtration. The resulting product is re-dispersed in 3 liters of a 40° C. deionized water, and stirred for 15 minutes at 300 rpm to wash. This washing procedure is repeated 5 times, and the product is subjected to solid-liquid separation by Nutsche suction filtration, followed by vacuum drying for 12 hours to obtain toner particles 1.

Measurement of the toner particles 1 with a Coulter counter reveals a cumulative volume average diameter $D_{50}$ of 4.5 μm, and a volume average particle size index GSDv of 1.23. Also, observation of the particle shape with a Luzex image analyzer reveals that the shape factor SF1 of the toner particles is 128 and is potato-like.

To 50 parts of the toner particles is added 1.5 parts of hydrophobic silica (TS720; manufactured by Cabot Corporation), and the resulting mixture is mixed in a sample mill to obtain an external addition toner.

Then, the external addition toner is weighed so that the toner content becomes 5% using a ferrite carrier of 50 μm in average particle diameter coated with polymethyl methacrylate (manufactured by Soken Chemical & Engineering Co., Ltd.) in a coating amount of 1%, and the mixture is stirred and mixed in a ball mill for 5 minutes to prepare a developer.

Evaluation of Toner

Fixing properties of the toner is evaluated by using a modified machine of DocuCenterColor f450 (manufactured by Fuji Xerox Co., Ltd.) which has been modified so that the two-roll type fixing machine therein can produce the maximum fixing pressure of 0.4 MPa, using as a recording material S paper specified by Fuji Xerox Co., Ltd., and adjusting the process speed at 180 mm/sec, thus excellent pressure fixing properties being found. In the cloth-rubbing test, the formed image showed sufficient fixing uniformity (fixing uniformity: A). The temperature inside the machine is 30° C.

Also, after leaving the copier for 15 hours under the conditions of 23° C. and a high humidity of 80% together with paper, a continuously printing test is conducted in a laboratorial environment to produce 50,000 prints. As a result, it is found that fixing and peeling properties are excellent, with the initial good image quality being maintained to the last print (Continuous run-maintaining properties: A). Regarding the temperature inside the copier during the continuous run, the highest temperature is about 40° C.

Examples 2 to 7, Comparative Examples 1 and 2

Hereinafter, toners of Examples 2 to 7 and Comparative Examples 1 and 2 are prepared according to the combinations of components shown in Table 3, and are fixed at a fixing temperature shown in Table 3. The evaluation results are shown in Table 3.

Incidentally, with toners of Examples 1 and 2, the maximum fixing pressure is set to 0.4 MPa and, with toners of Examples 3 and 4, the maximum fixing pressure is set to 4 MPa and, with toners of Examples 5 to 7, the maximum fixing pressure is set to 0.2 MPa. Also, in Comparative Examples 1 and 2, the maximum fixing pressures are set to 4.0 MPa and 0.2 MPa, respectively.

TABLE 3

| | Examples and Comparative Examples | | | | | | | | |
|---|---|---|---|---|---|---|---|---|---|
| | Example 1 | Example 2 | Example 3 | Example 4 | Example 5 | Example 6 | Example 7 | Comparative Example 1 | Comparative Example 2 |
| Resin particle dispersion | A1 | A1 | A1 | A2 | A3 | A1 | A1 | A1 | A4 |
| Releasing agent particle dispersion | B1 | B2 | B3 | B1 | B2 | B5 | B6 | B4 | B2 |
| Toner D50 (μm) | 4.5 | 5.1 | 5.5 | 5.8 | 4.9 | 5.5 | 5.3 | 4.8 | 4.6 |
| GSDv | 1.23 | 1.22 | 1.24 | 1.21 | 1.22 | 1.23 | 1.24 | 1.22 | 1.23 |
| Shape factor (SF1) | 128 | 130 | 120 | 134 | 130 | 129 | 128 | 125 | 126 |
| Fixing Pressure (MPa) | 0.4 | 0.4 | 4.0 | 0.2 | 0.2 | 0.4 | 0.4 | 4.0 | 0.2 |
| Fixing uniformity | A | A | A | A | A | A | A | A | B Poor fixing degree |
| Continuous run-maintaining properties under high-humidity environment | A | A | A | A | A | A | A | B paper jam occurring at 2,000 prints | A |

What is claimed is:

1. An electrostatic-image-developing toner obtained by aggregating:

resin particles, each of which has a core-shell structure, in which a difference in glass transition temperature between a resin constituting the core and a resin constituting the shell is about 20° C. or more; and releasing agent particles, each of which comprises a polyester block copolymer having a weight-average molecular weight of about 3,000 or less and containing a non-crystalline polyester block containing a cyclic structure in a main chain and a crystalline polyester block containing no cyclic structure in the main chain.

2. The electrostatic-image-developing toner according to claim 1, wherein at least either the resin constituting the core or the resin constituting the shell contains a non-crystalline addition polymerization type resin.

3. The electrostatic-image-developing toner according to claim 1, wherein the resin constituting the shell has an acidic or basic polar group or an alcoholic hydroxyl group.

4. The electrostatic-image-developing toner according to claim 3, wherein the acidic polar group is any one of a carboxyl group, a sulfonic acid group, and an acid anhydride.

5. The electrostatic-image-developing toner according to claim 3, wherein the basic polar group is any one of an amino group, an amido group, and a hydrazide group.

6. The electrostatic-image-developing toner according to claim 5, wherein a monomer for forming the basic polar group is a (meth) acrylic acid amide compound, a (meth)acrylic acid hydrazide compound, or an aminoalkyl (meth)acrylate compound.

7. The electrostatic-image-developing toner according to claim 3, wherein a monomer for forming the alcoholic hydroxyl group is a hydroxy acrylate.

8. The electrostatic-image-developing toner according to claim 1, wherein the glass transition temperature of the resin constituting the shell is higher than the glass transition temperature of the resin constituting the core.

9. The electrostatic-image-developing toner according to claim 8, wherein about 80% by weight of monomer units constituting the resin constituting the core are a (meth)acrylic acid ester.

10. The electrostatic-image-developing toner according to claim 1, wherein the resin constituting the core has a weight-average molecular weight of from about 3,000 to about 50,000.

11. The electrostatic-image-developing toner according to claim 1, wherein the resin constituting the shell has a weight-average molecular weight of from about 3,000 to about 50,000.

12. The electrostatic-image-developing toner according to claim 1, wherein a weight ratio of the resin constituting the core to the resin constituting the shell is from about 10:90 to about 90:10.

13. The electrostatic-image-developing toner according to claim 1, wherein a weight ratio of the non-crystalline polyester block to the crystalline polyester block is from about 1:20 to about 20:1.

14. The electrostatic-image-developing toner according to claim 1, wherein a crystalline polyester resin for forming the crystalline polyester block has a crystal melting temperature of from about 40° C. to about 150° C.

15. An electrostatic image developer comprising:

the electrostatic-image-developing toner described in claim 1; and a carrier.

* * * * *